US007369020B2

(12) United States Patent
Kanno et al.

(10) Patent No.: US 7,369,020 B2
(45) **Date of Patent: *May 6, 2008**

(54) TRANSMISSION LINE COMPRISING A PLURALITY OF SERIALLY CONNECTED ROTATIONAL DIRECTION-REVERSAL STRUCTURES

(75) Inventors: Hiroshi Kanno, Osaka (JP); Kazuyuki Sakiyama, Osaka (JP); Ushio Sangawa, Nara (JP); Tomoyasu Fujishima, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/589,141

(22) Filed: Oct. 30, 2006

(65) Prior Publication Data

US 2007/0040634 A1 Feb. 22, 2007

Related U.S. Application Data

(63) Continuation of application No. PCT/JP2006/306527, filed on Mar. 29, 2006.

(30) Foreign Application Priority Data

Mar. 30, 2005 (JP) ..... 2005-097370

(51) Int. Cl.
*H01P 3/08* (2006.01)

(52) U.S. Cl. ..... 333/238

(58) Field of Classification Search ..... 333/116, 333/161, 238, 99 S

See application file for complete search history.

(56) References Cited

U.S. PATENT DOCUMENTS 3,609,600 A * 9/1971 Kassabgi ..... 333/156

(Continued)

FOREIGN PATENT DOCUMENTS

JP 4-196601 A 7/1992

(Continued)

OTHER PUBLICATIONS

"An Introduction to Signal Integrity," Jun. 1, 2002, pp. 79, CQ Publishing Co., Ltd.

(Continued)

*Primary Examiner*—Benny Lee
(74) *Attorney, Agent, or Firm*—McDermot Will & Emery LLP

(57) ABSTRACT

One transmission line includes a first signal conductor which is placed on one surface of a substrate formed from a dielectric or semiconductor and which is formed so as to be curved toward a first rotational direction within the surface, and a second signal conductor which is formed so as to be curved toward a second rotational direction opposite to the first rotational direction and which is placed in the surface so as to be electrically connected in series to the first signal conductor, wherein a transmission-direction reversal portion in which a signal is transmitted along a direction reversed with respect to a signal transmission direction of the transmission line as a whole is formed so as to include at least part of the first signal conductor and part of the second signal conductor. Such a transmission line is capable of obtaining a suppression effect of unwanted radiation intensity.

7 Claims, 22 Drawing Sheets

U.S. PATENT DOCUMENTS

| | | | | |
|---|---|---|---|---|
| 4,375,053 | A * | 2/1983 | Viola et al. | 333/116 |
| 5,818,308 | A * | 10/1998 | Tanaka et al. | 333/116 |
| 6,026,311 | A * | 2/2000 | Willemsen Cortes et al. | 505/210 |
| 6,029,075 | A * | 2/2000 | Das | 505/210 |

FOREIGN PATENT DOCUMENTS

| | | |
|---|---|---|
| JP | 7-46010 | 2/1995 |
| JP | 11-17409 A | 1/1999 |
| JP | 2000-77911 A | 3/2000 |
| JP | 2004-274172 | 9/2004 |

OTHER PUBLICATIONS

Japanese Office Action issued in corresponding Japanese Patent Application No. JP 2006-524146, dated Mar. 13, 2007.

Japanese Office Action issued in corresponding Japanese Patent Application No. JP 2006-524147, dated Mar. 13, 2007.

* cited by examiner

TRANSMISSION LINE COMPRISING A PLURALITY OF SERIALLY CONNECTED ROTATIONAL DIRECTION-REVERSAL STRUCTURES

This is a continuation application of International Application No. PCT/JP2006/306527, filed Mar. 29, 2006.

BACKGROUND OF THE INVENTION

1. Field of the Invention

The present invention relates to a single-end transmission line for transmitting analog radio-frequency signals of microwave band, millimeter-wave band or the like or digital signals, and further relates to a radio-frequency circuit which contains such a transmission line.

2. Description of the Related Art

FIG. 18A shows a schematic cross-sectional structure of a microstrip line which has been used as a transmission line in such a conventional radio-frequency circuit as shown above. As shown in FIG. 18A, a signal conductor 103 is formed on a top face of a board 101 made of a dielectric or semiconductor, and a grounding conductor layer 105 is formed on a rear face of the board 101. Upon input of radio-frequency power to this microstrip line, an electric field arises along a direction from the signal conductor 103 to the grounding conductor layer 105, and a magnetic field arises along such a direction as to surround the signal conductor 103 perpendicular to lines of electric force. As a result, the electromagnetic field propagates the radio-frequency power in a lengthwise direction perpendicular to the widthwise direction of the signal conductor 103. In addition, in the microstrip line, the signal conductor 103 or the grounding conductor layer 105 does not necessarily need to be formed on the top face or the rear face of the board 101, but the signal conductor 103 or the grounding conductor layer 105 may be formed within the inner-layer conductor surface of the circuit board on condition that the board 101 is provided as a multilayer circuit board.

Since transmission of a radio-frequency signal along the microstrip line involves a distribution of radio-frequency magnetic fields around the transmission line, there arises unwanted radiation of electromagnetic waves. Whereas a structure in which grounding conductors are placed on both sides of a signal conductor to make an electromagnetic shielding from the external field as in strip lines makes it possible to suppress the unwanted radiation to some extent, it is impossible, in principle, for microstrip lines to suppress the unwanted radiation because the microstrip line has the grounding conductor only on one side of the board.

The above description has been made on a transmission line for use of transmission of single-end signals. However, as shown in a sectional view of a line structure in FIG. 18B, it becomes possible to reduce unwanted radiation when two microstrip line structures 103*a*, 103*b* are placed in parallel on a top face of a board 101 made of a dielectric or semiconductor, and a grounding conductor layer 105 is formed on a rear face of the board 101 so that 103*a* and 103*b* are used as differential signal transmission lines by with signals of opposite phases transmitted through the lines, respectively. However, in this case, there arises a problem that the circuit occupation area increases because of the need for paired signal conductors. Also, whereas radio-frequency signals are not superimposed in principle in a bias line for supplying a bias to active elements within the circuit, insufficient processing in the circuit may cause leakage of the radio-frequency signals, which may cause unwanted radiation. The bias line, which is a line for DC current supply, would not be suitable with a differential structure. That is, since it is inevitably necessary for the bias line to be a microstrip line structure, there arises a need for a structure for reducing unwanted radiation.

Now, the principle of occurrence of unwanted radiation is explained by using a schematic perspective view of a typical transmission line shown in FIG. 19. A linear transmission line 291 is so constructed that a grounding conductor 105 formed on a rear face of a dielectric substrate 101 serves as its grounding conductor part and one signal conductor placed linearly on a top face 281 of the dielectric substrate 101 serves as its signal conductor part. Assuming that both ends of the transmission line 291 are terminated by unshown resistors, respectively, radio-frequency circuit characteristics of the one transmission line 291, i.e. the origin of unwanted radiation in this case, can be understood by substituting a current-flowing closed current loop 293*a* for the transmission line 291. As shown in FIG. 19, due to a radio-frequency current 853 that has flowed through the current loop 293*a*, a radio-frequency magnetic field 855 is induced so as to extend through the current loop 293*a*, causing radiation due to the radio-frequency magnetic field 855 to be generated. The closed loop has an area indicated by the label A. In this case, since the intensity of the radio-frequency magnetic field 855 is proportional to a loop area A of the current loop 293*a*, there holds a proportional relationship between the loop area A of the current loop 293*a* and a radiation electric field strength E. Moreover, a proportional relationship holds also between the square of the frequency f of the radio-frequency current and the radiation electric field strength E, and moreover a proportional relationship also holds between the current amount I of the flowing radio-frequency current and the radiation electric field strength E. That is, in a radio-frequency circuit, there is a tendency that increasing transmission line length causes the loop area A to increase more and more so that the unwanted radiation also increases, and further that higher-speed signals transmitted as well as increased current amounts cause unwanted radiation to increase.

SUMMARY OF THE INVENTION

However, the conventional microstrip lines have principle-based issues shown below.

A conventional microstrip line structure has a drawback of large amounts of unwanted radiation because of its not having an electromagnetically complete shield. As to the amount of unwanted radiation that leaks from electronic equipment, as there are provided international standards that should be observed, it is necessary to invent a circuit structure that allows the unwanted radiation to be reduced as much as possible so as to prevent the formation of an unwanted radiation source due to coupling with any unintentional resonance phenomena within the circuit. However, as the signal to be treated goes increasingly higher in speed, higher-frequency components come to be contained in the transmission signal, causing the unwanted radiation intensity to increase.

Accordingly, an object of the present invention, lying in solving the above-described problems, is to provide a transmission line which is capable of transmitting analog radio-frequency signals of microwave band or millimeter-wave band or the like or digital signals, and in which the effect of suppression of unwanted radiation can be obtained.

In order to achieve the above object, the present invention has the following constitutions.

According to a first aspect of the present invention, there is provided a transmission line comprising:

a first signal conductor which is placed on one surface of a substrate formed from a dielectric or semiconductor and which is formed so as to be curved toward a first rotational direction within the surface; and a second signal conductor which is formed so as to be curved toward a second rotational direction opposite to the first rotational direction and which is placed in the surface of the substrate so as to be electrically connected in series to the first signal conductor, wherein a transmission-direction reversal portion in which a signal is transmitted along a direction reversed with respect to a signal transmission direction of the transmission line as a whole is formed so as to include at least part of the first signal conductor and part of the second signal conductor.

That is, the linear first signal conductor is formed so as to be curved toward the first rotational direction, a terminating end of the first signal conductor and a starting end of the second signal conductor are electrically connected to each other, and the linear second signal conductor is formed so as to be curved toward the second rotational direction, by which a rotational-direction reversal structure is made up.

It is noted here that the term "rotational-direction reversal structure" refers to an electrically continued line which is formed by a linear signal conductor and which has such a structure that a direction of a signal transmitted in the line is reversed from the first rotational direction to the second rotational direction.

Further, in the transmission line, a "transmission-direction reversal portion" which is a section at which a signal is transmitted along a direction reversed with respect to a signal transmission direction of the transmission line as a whole is formed from the first signal conductor, the second signal conductor or other signal conductors.

Also, in the transmission line of the first aspect, a direction of a magnetic field generated upon flow of a current can be locally changed by making the signal conductors connected to each other so as to be curved in different directions within the rotational-direction reversal structure. As a result of this, the continuity of the transmission line in the lengthwise direction of the current loop, which has been a cause of increases of unwanted radiation, can be locally cut off, so that unwanted radiation can be suppressed to a lower intensity.

Furthermore, by the provision of the transmission-direction reversal portion for reversing the signal transmission direction, unwanted radiation intensity can be further reduced by making opposite-direction magnetic fields generated in the transmission-direction reversal portion so that the magnetic fields are canceled out in the transmission line as a whole.

According to a second aspect of the present invention, there is provided the transmission line as defined in the first aspect, wherein the curve of each of the first signal conductor and the second signal conductor is circular-arc shaped.

According to a third aspect of the present invention, there is provided the transmission line as defined in the first aspect, wherein the first signal conductor and the second signal conductor are placed in point symmetry with respect to a center of a connecting portion between the first signal conductor and the second signal conductor.

According to a fourth aspect of the present invention, there is provided the transmission line as defined in the first aspect, wherein each of the first signal conductor and the second signal conductor has the curved shape having a rotational angle of 180 degrees or more.

According to a fifth aspect of the present invention, there is provided the transmission line as defined in the first aspect, wherein the transmission-direction reversal portion has its signal transmission direction which is a direction having an angle of more than 90 degrees with respect to the signal transmission direction of the transmission line as a whole.

According to a sixth aspect of the present invention, there is provided the transmission line as defined in the fifth aspect, wherein the transmission-direction reversal portion has its signal transmission direction which is a direction having an angle of 180 degrees with respect to the signal transmission direction of the transmission line as a whole.

According to a seventh aspect of the present invention, there is provided the transmission line as defined in the first aspect, further comprising a third signal conductor (a conductor-to-conductor connection use signal conductor) for electrically connecting the first signal conductor and the second signal conductor to each other, wherein the transmission-direction reversal portion is formed so as to include the third signal conductor.

According to an eighth aspect of the present invention, there is provided the transmission line as defined in the first aspect, wherein the first signal conductor and the second signal conductor are electrically connected to each other via a dielectric, and wherein the dielectric, the first signal conductor and the second signal conductor make up a capacitor structure.

According to a ninth aspect of the present invention, there is provided the transmission line as defined in the first aspect, wherein the first signal conductor and the second signal conductor are set to line lengths, respectively, which are non-resonant at a frequency of a transmission signal.

According to a tenth aspect of the present invention, there is provided the transmission line as defined in the seventh aspect, wherein the third signal conductor is set to a line length which is non-resonant at a frequency of a transmission signal.

It is noted that the frequency of the transmission signal refers to, for example, an upper-limit frequency of the transmission band.

According to an eleventh aspect of the present invention, there is provided the transmission line as defined in the first aspect, wherein a plurality of rotational-direction reversal structures each formed by electrical connection between the first signal conductor and the second signal conductor are connected to one another in series to the signal transmission direction of the transmission line as a whole.

According to a twelfth aspect of the present invention, there is provided the transmission line as defined in the eleventh aspect, wherein adjacent rotational-direction reversal structures are connected to each other by a fourth signal conductor used for a structure-to-structure connection.

According to a thirteenth aspect of the present invention, there is provided the transmission line as defined in the twelfth aspect, wherein the fourth signal conductor is placed along a direction different from the signal transmission direction of the transmission line as a whole.

As in the eleventh aspect, when the transmission line is formed by connecting the plurality of rotational-direction reversal structures in series to one another, advantageous effects of the present invention can be given to the transmission signal continuously. Also, the plurality of rotational-direction reversal structures may be connected to one another either in direct connection or, as in the thirteenth aspect, via the fourth signal conductor.

According to a fourteenth aspect of the present invention, there is provided the transmission line as defined in the eleventh aspect, wherein the plurality of rotational-direction reversal structures are placed over an effective line length which is 0.5 time or more as long as an effective wavelength at a frequency of a transmission signal.

According to a fifteenth aspect of the present invention, there is provided the transmission line as defined in the eleventh aspect, wherein the plurality of rotational-direction reversal structures are placed over an effective line length which is 1 time or more as long as an effective wavelength at a frequency of a transmission signal.

As in the fourteenth or fifteenth aspect, when the rotational-direction reversal structures are arrayed in continuation over an effective line length which is 0.5 time or more, more preferably 1 time or more, as long as an effective wavelength at a frequency of a transmission signal, the unwanted radiation suppression effect can be further enhanced in the transmission line of the present invention.

Furthermore, in the transmission line of the present invention, with a view to avoiding the resonance of transmission signals, it is preferable that the first and second signal conductors, and the third signal conductor, as well as the fourth signal conductor, are set to line lengths shorter than wavelengths of transmitted electromagnetic waves, respectively. It is preferable that the effective line length of each structure is set to ¼ or less of the effective wavelength of the electromagnetic wave at the frequency of the transmission signal.

Also, within the rotational-direction reversal structure of the transmission line of the present invention, it is preferable that the first signal conductor and the second signal conductor are placed in a point-symmetrical relationship about a rotational axis which is a center of a connecting portion between the first signal conductor and the second signal conductor or the third signal conductor that connects the first signal conductor and the second signal conductor to each other. Moreover, even if the rotational symmetry can not be maintained for some reason, the advantageous effects of the invention can be obtained by setting the first signal conductor and the second signal conductor equal in the number of rotations Nr to each other.

Also, for the suppression of unwanted radiation in the transmission line of the invention, it is preferable that the number of rotations Nr is set to 0.5 or more for each of the first signal conductor and the second signal conductor, and more preferably, set within a range from 0.75 to 2 under practical use conditions.

According to the transmission line of the present invention, it becomes achievable to suppress unwanted electromagnetic-wave radiation to an intensity level extremely lower than that of conventional transmission lines. Therefore, there can be provided a radio-frequency circuit which is quite high in wiring density, area-saving, and less liable to malfunctions even during high-speed operation.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
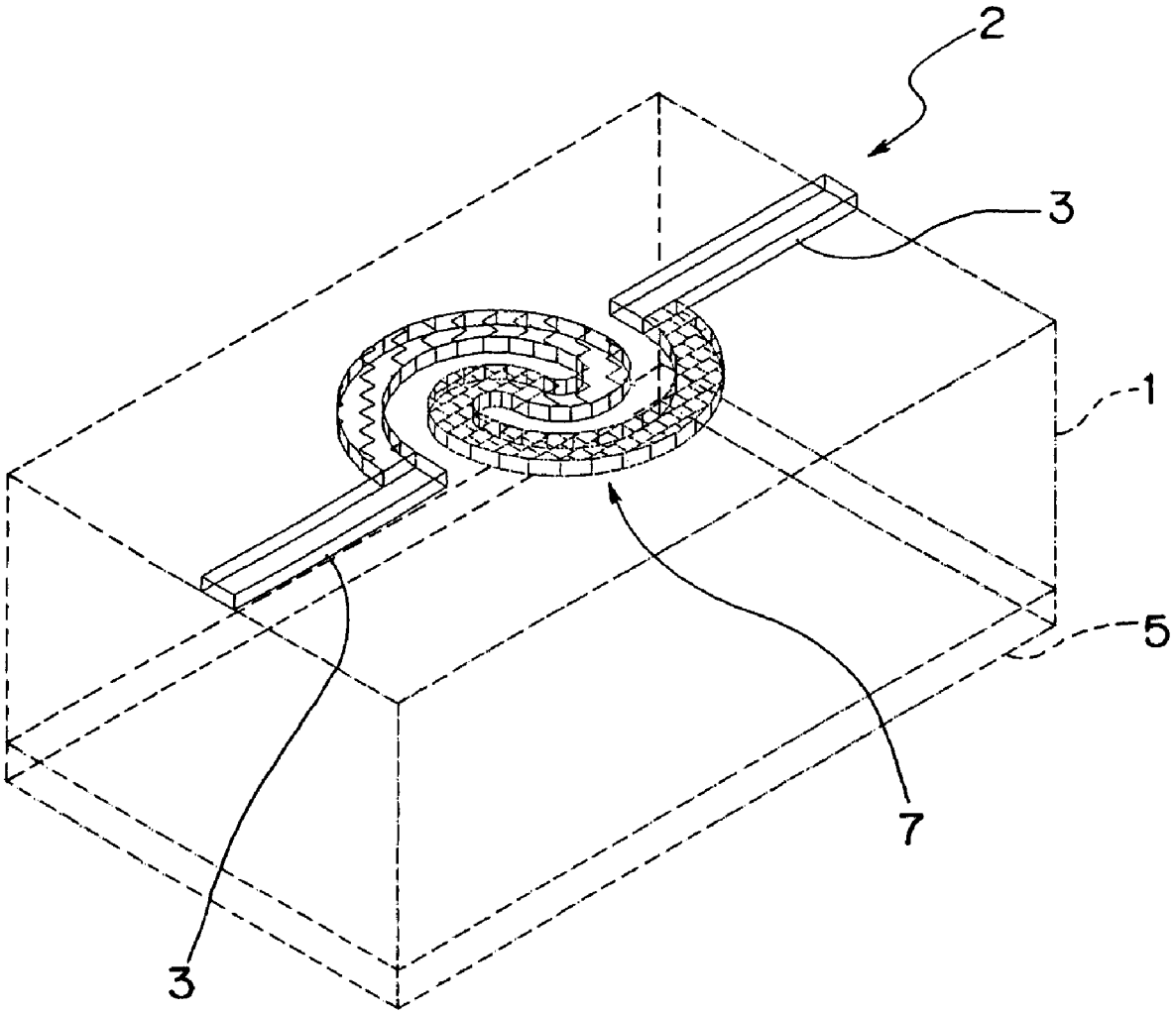
FIG. 1 is a schematic perspective view of a transmission line according to one embodiment of the present invention.

Before the description of the present invention proceeds, it is to be noted that like parts are designated by like reference numerals throughout the accompanying drawings and may not be described in detail for all drawing figures.

Hereinbelow, one embodiment of the present invention is described in detail with reference to the accompanying drawings.

Embodiment

FIG. 1 shows a schematic plan view of a transmission line 2 according to an embodiment of the present invention. As shown in FIG. 1, the transmission line 2 includes one signal conductor 3 formed on a top face of a dielectric substrate 1, and a grounding conductor layer 5 formed on a rear face of the dielectric substrate 1. The signal conductor 3 includes a signal conductor portion having a roughly spiral-shaped rotational structure that is a later-described rotational-direction reversal structure 7. First, an explanation will be made on a detailed structure of the rotational-direction reversal structure 7 of the transmission line 2 shown above as well as on the principle of unwanted radiation suppression obtained by the structure.

Figure 2A:
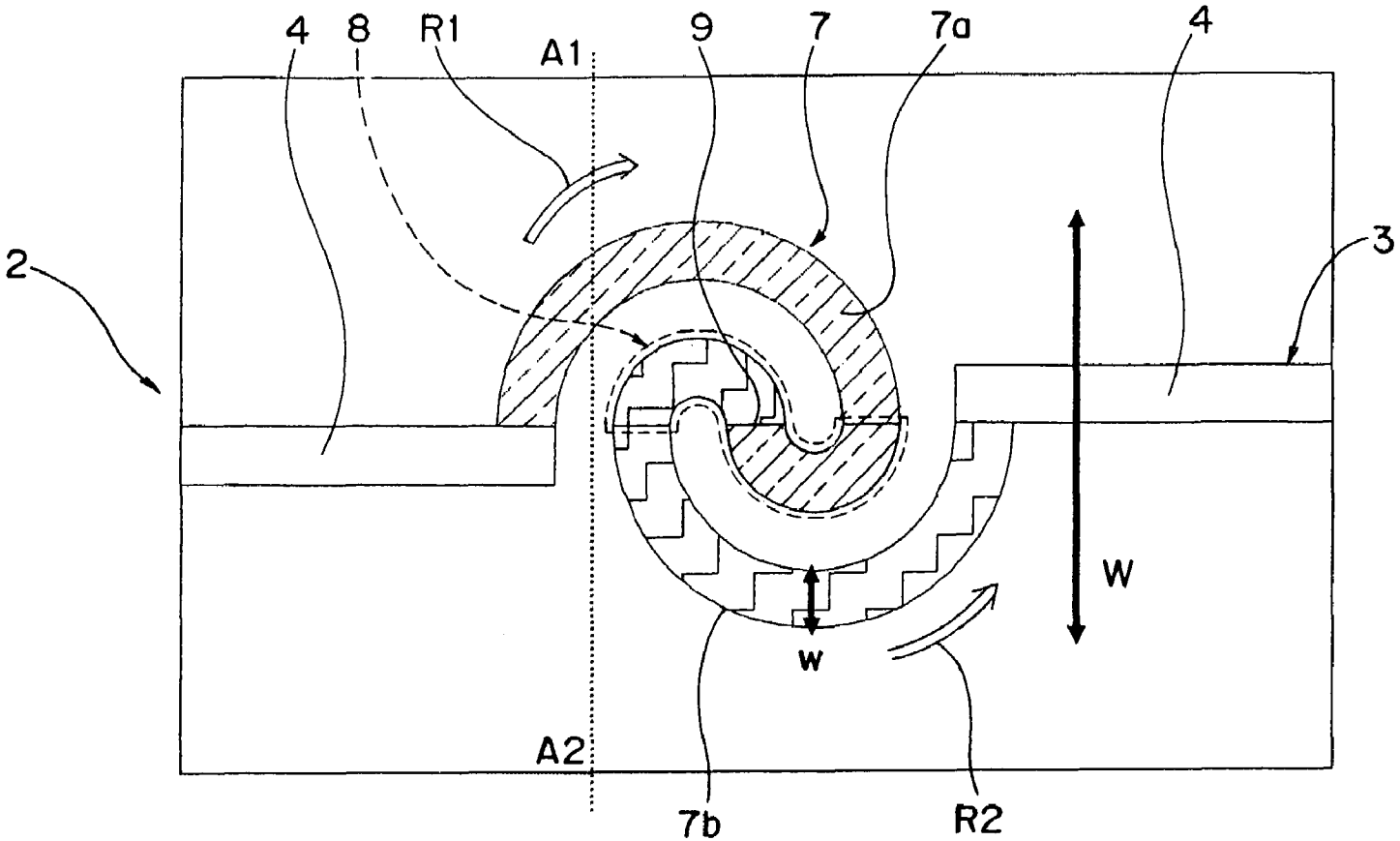
FIG. 2A is a schematic plan view of the transmission line of FIG. 1.
Figure 2B:
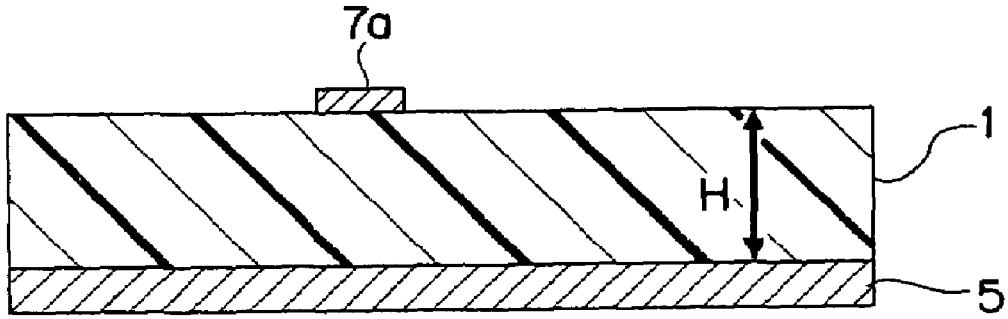
FIG. 2B is a schematic sectional view of the transmission line of FIG. 2A taken along the line A1-A2.

In conjunction with this description, FIG. 2A shows a schematic plan view of the transmission line 2 shown in FIG. 1, and FIG. 2B shows a sectional view of the transmission line 2 of FIG. 2A taken along the line A1-A2. The label W indicates a total wiring region width W of the transmission line 2 in FIG. 2A. The label H indicates a thickness of the dielectric substrate 1 in FIG. 2B.

As shown in FIGS. 2A and 2B, the signal conductor 3 is formed on a top face of the dielectric substrate 1 and the grounding conductor layer 5 is formed on its rear face as shown in FIG. 2B, making up the transmission line 2. Assuming that the signal is transmitted from the left to the right side as viewed in FIG. 2A, the signal conductor 3 of the transmission line 2 of this embodiment has a structure, at least in part of the region, that a first signal conductor 7*a* and a second signal conductor 7*b* are electrically connected to each other at a connecting portion 9, where the first signal conductor 7*a* functions to rotate a radio-frequency current by just one rotation in a spiral shape (i.e., 360-degree rotation) along a first rotational direction (clockwise direction in the figure) R1 within the surface of the substrate 1, and the second signal conductor 7*b* functions to rotate a radio-frequency current by just one rotation in a spiral shape along a second rotational direction (counterclockwise direction in the figure) R2, which is opposite to the first rotational direction R1, (i.e., reverse rotation). In this embodiment, such a structure forms a rotational-direction reversal structure 7. It is noted that in the signal conductor 3 shown in FIG. 2A, the first signal conductor 7*a* and the second signal conductor 7*b* are hatched in mutually different patterns for a clear showing of ranges of the first signal conductor 7*a* the second signal conductor 7*b*.

As shown in FIG. 2A, the rotational-direction reversal structure 7, which is formed of a signal conductor having a specified line width w, includes the first signal conductor 7*a* having a spiral shape of a smooth circular arc formed so as to be curved toward the first rotational direction R1, the second signal conductor 7*b* having a spiral shape of a smooth circular arc formed so as to be curved toward the second rotational direction R2, and the connecting portion 9 which electrically connects one end portion of the first signal conductor 7*a* and one end portion of the second signal conductor 7*b* to each other. Further, as shown in FIG. 2A, with a base point given by a center of the connecting portion 9, the first signal conductor 7*a* and the second signal conductor 7*b* are in rotational symmetry (or point symmetry), where an axis (not shown) extending vertically through the dielectric substrate 1 at the center of the connecting portion 9 corresponds to the rotational axis of the rotational symmetry.

Further, as shown in FIG. 2A, in the rotational-direction reversal structure 7, the first signal conductor 7*a* is formed into a signal conductor of a spiral shape having a 360-degree rotational structure by the connection between a semicircular-arc shaped signal conductor having a relatively small curvature of its curve and a semicircular-arc shaped signal conductor having a relatively large curvature of its curve. This is the case also with second signal conductor. Then, two semicircular-arc shaped signal conductors having large curvatures of the curves are electrically connected to each other at the connecting portion 9, by which the rotational-direction reversal structure 7 is made up. In addition, as shown in FIG. 2A, individual end portions of the rotational-direction reversal structure 7, i.e., an outer end portion of the first signal conductor 7*a* and an outer end portion of the second signal conductor 7*b*, are connected to a generally linear-shaped external signal conductors 4.

Also in the rotational-direction reversal structure 7, with the signal transmission direction in the transmission line 2 assumed as a direction from the left to the right side as viewed in the figure, a transmission-direction reversal portion 8 (a portion surrounded by broken line) for transferring a signal toward a direction reverse to the above-mentioned transmission direction is provided. It is noted that the transmission-direction reversal portion 8 is composed of part of the first signal conductor 7*a* and part of the second signal conductor 7*b*.

Figure 21:
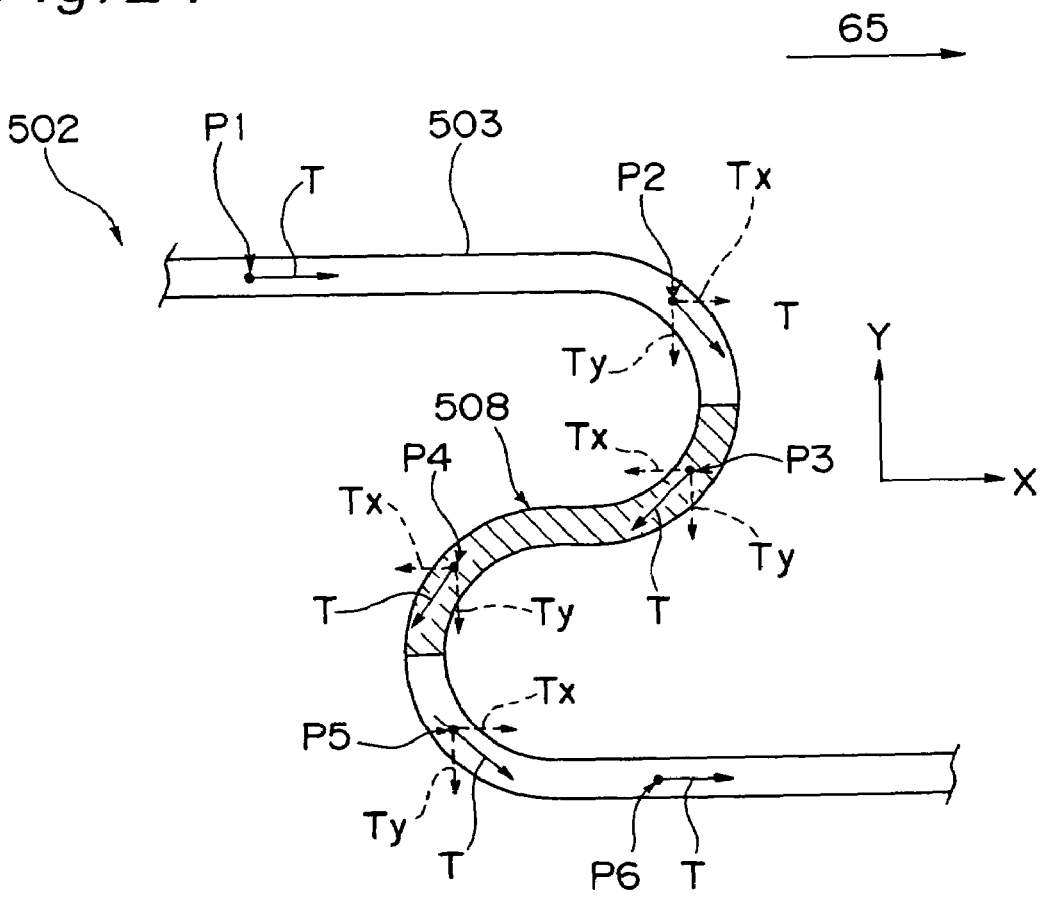
FIG. 21 is a schematic plan view for explaining a transmission direction and a transmission-direction reversal portion in a transmission line of the foregoing embodiment of the invention.

Now, the signal transmission direction in a transmission line is explained below with reference to a schematic plan view of a transmission line shown in FIG. 21. Herein, the transmission direction is a tangential direction of a signal conductor when the signal conductor has a curved shape, and the transmission direction is a longitudinal direction of a signal conductor when the signal conductor has a linear shape. More specifically, by taking an example of a transmission line 502 formed of a signal conductor 503 having a signal conductor portion of a linear shape and a signal conductor portion of a circular-arc shape as shown in FIG. 21, at local positions P1 and P2 in the linear-shaped signal conductor portion, the transmission direction T is the rightward direction, which is the longitudinal direction of the signal conductor, in the figure. On the other hand, at local positions P2 to P5 in the signal conductor portion of the circular-arc shape, their transmission directions T are tangential directions at the local positions P2, P3, P4, and P5, respectively. Label 503 indicates a signal conductor.

Also, in the transmission line 502 of FIG. 21, assuming that a signal transmission direction 65 in the whole transmission line 502 is the rightward direction as viewed in the figure, and that this direction is an X-axis direction and a direction orthogonal to the X-axis direction within the same plane is a Y-axis direction, then the transmission direction T at each of positions P1 to P6 can be decomposed into Tx, which is a component in the X-axis direction, and Ty, which is a component in the Y-axis direction. Tx becomes a + (positive) X-direction component at positions P1, P2, P5 and P6, while Tx becomes a − (negative) X-direction component at positions P3 and P4. Herein, a portion in which the transmission direction contains a −X-direction component as shown above is a "transmission-direction reversal portion." More specifically, the positions P3 and P4 are positions within a transmission-direction reversal portion 508, and a hatched portion in the signal conductor of FIG. 21 serves as the transmission-direction reversal structure 508. The transmission line of this embodiment necessarily includes such a transmission-direction reversal portion as shown above. It is noted that effects obtained by the placement of such a transmission-direction reversal portion and the like will be explained later.

Figure 3:
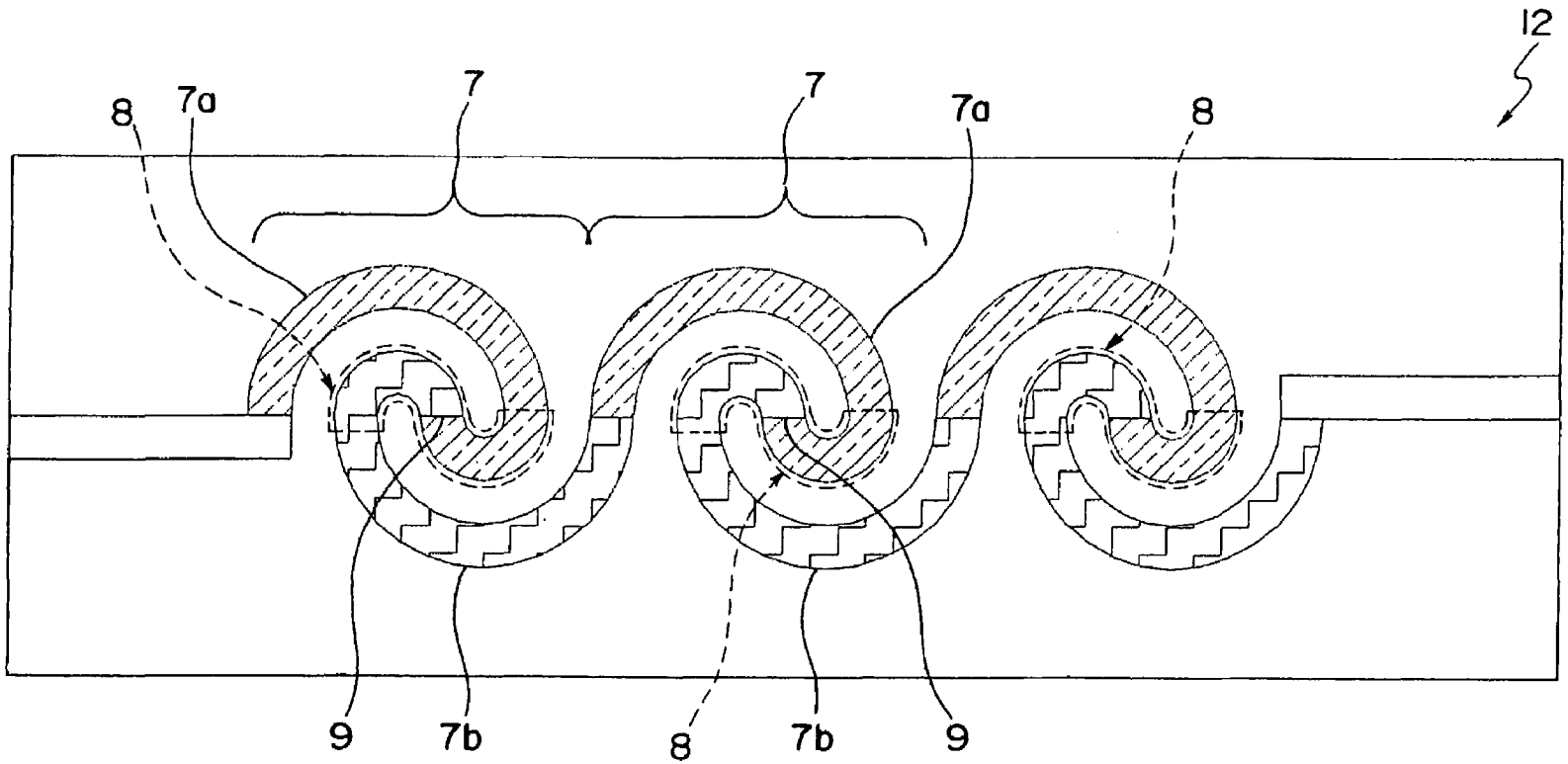
FIG. 3 is a schematic plan view of a transmission line according to a modification of the foregoing embodiment, showing a structure in which a plurality of rotational-direction reversal structures are connected in series.

Also, in order to obtain the advantageous effects of the present invention that the rotational-direction reversal structures 7 are connected to one another a plurality of times in series to make up a transmission line 12 as shown in a schematic plan view of the transmission line 12 according to a modification of this embodiment of FIG. 3. In FIG. 3, the individual rotational-direction reversal structures 7 to be adjoined by one another are connected to one another directly without intervention of any other signal conductors.

Figure 4:
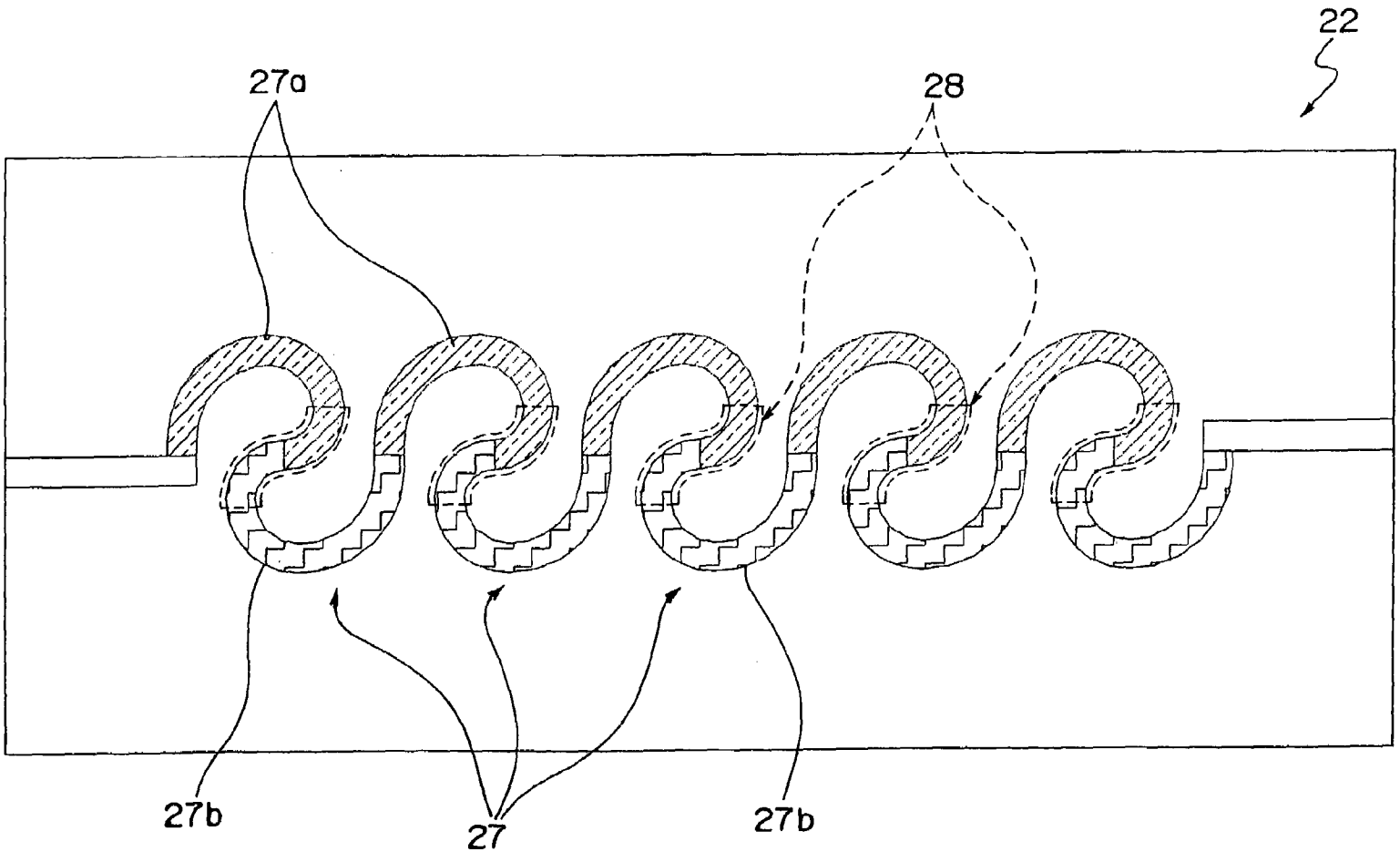
FIG. 4 is a schematic plan view of a transmission line according to a modification of the foregoing embodiment, showing a structure in which the number of rotations of the rotational-direction reversal structure is set to 0.75.
Figure 5:
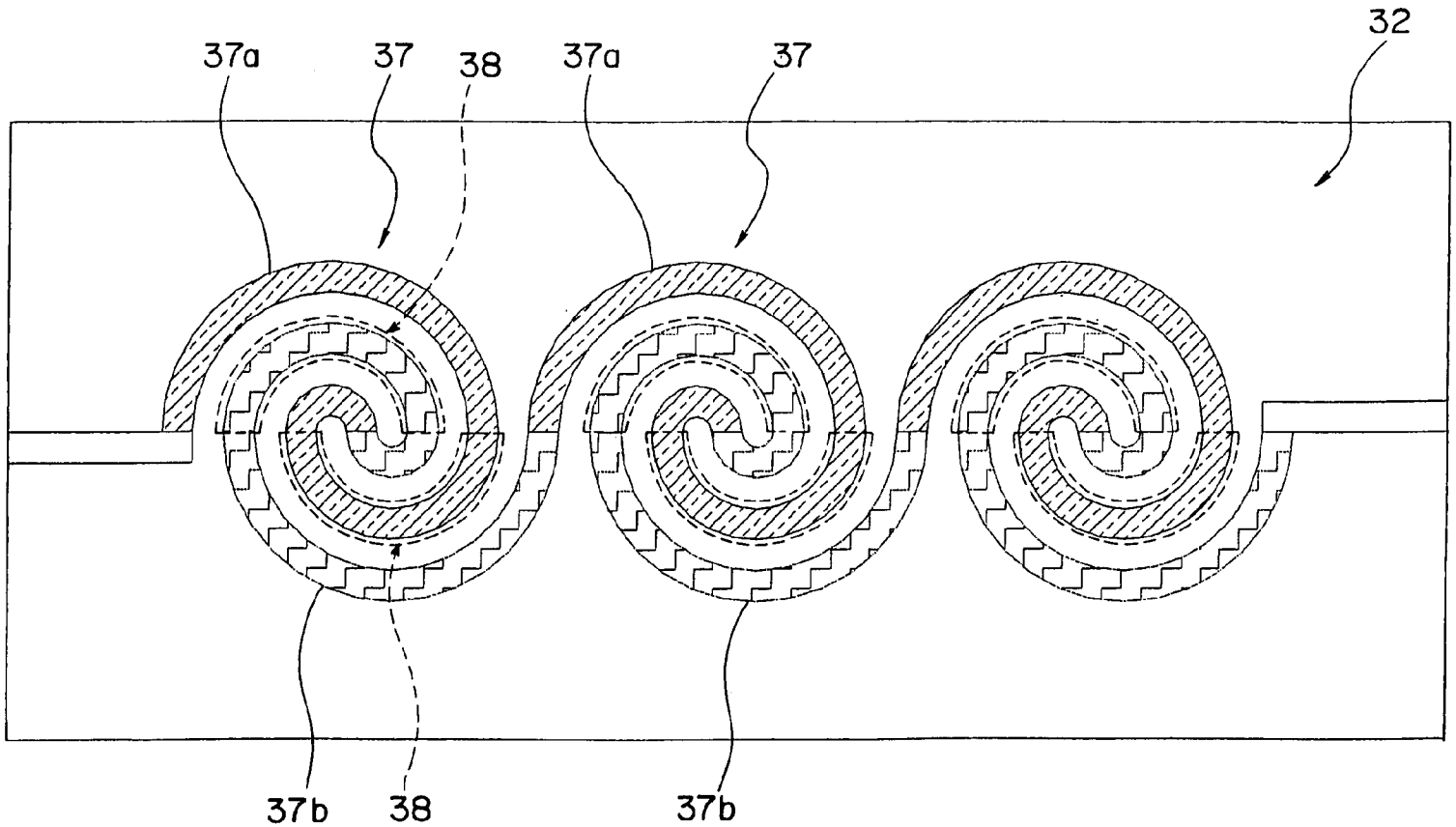
FIG. 5 is a schematic plan view of a transmission line according to a modification of the foregoing embodiment, showing a structure in which the number of rotations of the rotational-direction reversal structure is set to 1.5.

Also, as shown in FIG. 4, which is a schematic plan view of a transmission line 22 according to a modification of this embodiment, the case may be that the number of rotations Nr of a first signal conductor 27*a* and a second signal conductor 27*b* within the rotational-direction reversal structure 27 is set to Nr=0.75 rather than Nr=1 as for the rotational-direction reversal structure 7 in FIG. 2A. Further, as shown in FIG. 5, which is a schematic plan view of a transmission line 32, the case may be that the number of rotations Nr of a first signal conductor 37*a* and a second signal conductor 37*b* within the rotational-direction reversal structure 37 is set to Nr=1.5. In either case of the transmission lines 22, 32, the adopted structure includes the rotational-direction reversal structure 27, 37 and a transmission-direction reversal portion 28, 38. In addition, in the transmission line 22 of FIG. 4 and the transmission line 32 of FIG. 5, portions enclosed by broken line in the figure are the transmission-direction reversal portion 28, 38. In each rotational-direction reversal structure 37 of the transmission line 32 of FIG. 5, the transmission-direction reversal portion 38 is made up from two divisional portions. Further, although the case may be that the number of rotations Nr is set to ones other than the above, which is not shown, yet the number of rotations Nr needs to be set so that the rotational-direction reversal structure and the transmission-direction reversal portion are included as in the transmission lines of the above individual modifications.

However, although more advantageous effects are obtained with increasing number of rotations Nr in the rotational-direction reversal structure for the purpose of unwanted radiation suppression, yet the effects of the present invention may be lost when electrical lengths of the first signal conductor and the second signal conductor reach considerable line lengths with respect to the effective wavelength of the transmitted electromagnetic wave. Further, increases in the number of rotations Nr would cause increases also in the total wiring region width W, undesirable for area saving of the circuit. Also, increases in the total wiring length also could be a cause of signal delay. Moreover, since the effective wavelength of the electromagnetic wave becomes shorter at the upper limit of the transmission frequency band, setting the number of rotations to a high one would cause the wire lengths of the first signal conductor and the second signal conductor to approach the electromagnetic wavelength and therefore to the resonance condition as well, in which case reflection becomes more likely to occur and, as a result, the usable band for the transmission line of the present invention is limited, which is undesirable for practical use. Such unwanted reflection of signals would not only lead to intensity decreases or unwanted radiation of the transmitted signal, but also incur deteriorations of group delay frequency characteristics, which may lead to deterioration of the error rate for the system, undesirably. Consequently, a practical setting upper limit for the number of rotations Nr for the first signal conductor and the second signal conductor is, preferably, 2 rotations or lower in general use.

In addition, the transmission line 2 of this embodiment is not limited to the case where the signal conductors 3 is formed on the topmost surface of the dielectric substrate 1, but also may be formed on an inner-layer conductor surface (e.g., inner-layer surface in a multilayer-structure board). Similarly, the grounding conductor layer 5 as well is not limited to the case where it is formed on the bottommost surface of the dielectric substrate 1, but also may be formed on the inner-layer conductor surface. That is, herein, one face (or surface) of the board refers to a topmost surface or bottommost surface or inner-layer surface in a board of a single-layer structure or in a board of a multilayer-structure.

Figure 22:
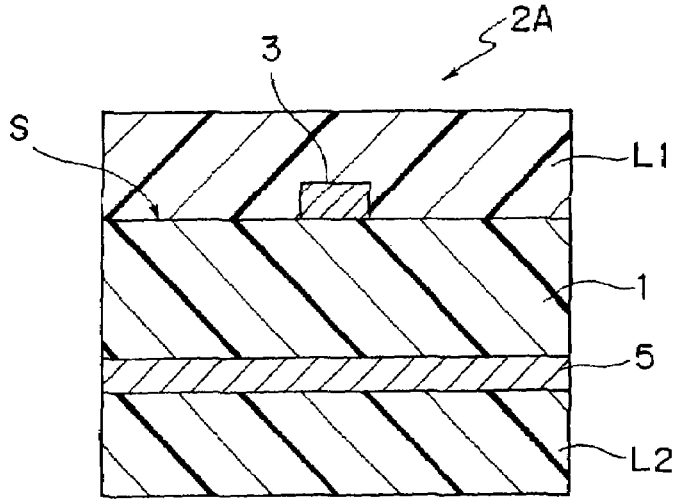
FIG. 22 is a schematic sectional view showing a structure in which another dielectric layer is placed on the surface of a dielectric substrate in the transmission line of the foregoing embodiment.
Figure 23:
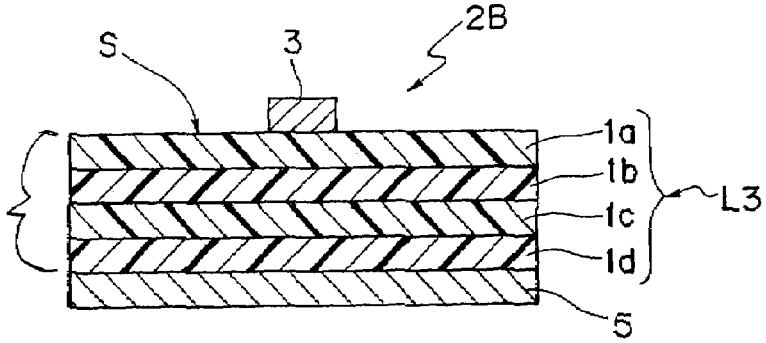
FIG. 23 is a schematic sectional view showing a structure in which the dielectric substrate is a multilayer body in the transmission line of the foregoing embodiment.
Figure 24:
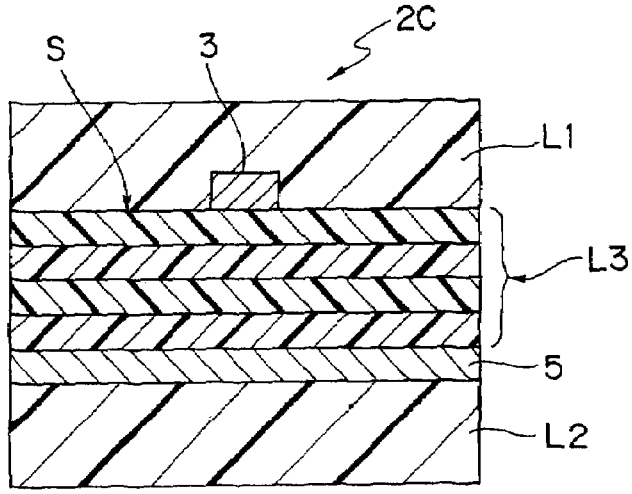
FIG. 24 is a schematic sectional view showing a structure in which the structure of the transmission line of FIG. 22 and the structure of the transmission line of FIG. 23 are combined together in the transmission line of the foregoing embodiment.

More specifically, as shown in a schematic sectional view of a transmission line 2A of FIG. 22, the structure may be that a signal conductor 3 is placed on one face (upper face in the figure) S of the dielectric substrate 1 while a grounding conductor layer 5 is placed on the other face (lower face in the figure), where another dielectric layer L1 is placed on the one face S of the dielectric substrate 1 while still another dielectric layer L2 is placed on the lower face of the grounding conductor layer 5. Further, like a transmission line 2B shown in a schematic sectional view of FIG. 23, the case may be that the dielectric substrate 1 itself is formed as a multilayer body L3 composed of a plurality of dielectric layers 1*a*, 1*b*, 1*c* and 1*d*, where a signal conductor 3 is placed on one face (upper face in the figure) S of the multilayer body L3 while a grounding conductor layer 5 is placed on the other face (lower face in the figure). Furthermore, it is also possible that, like a transmission line 2C shown in FIG. 24 having a structure in combination of the structure shown in FIG. 22 and the structure shown in FIG. 23, another dielectric layer L1 is placed on one face S of the multilayer body L3 while still another dielectric layer L2 is placed on the lower face of the grounding conductor layer 5. In any of the transmission lines 2A, 2B and 2C of the structures of FIGS. 22 to 24, the surface denoted by reference character S serves as the "surface (one face) of the board."

Figure 6:
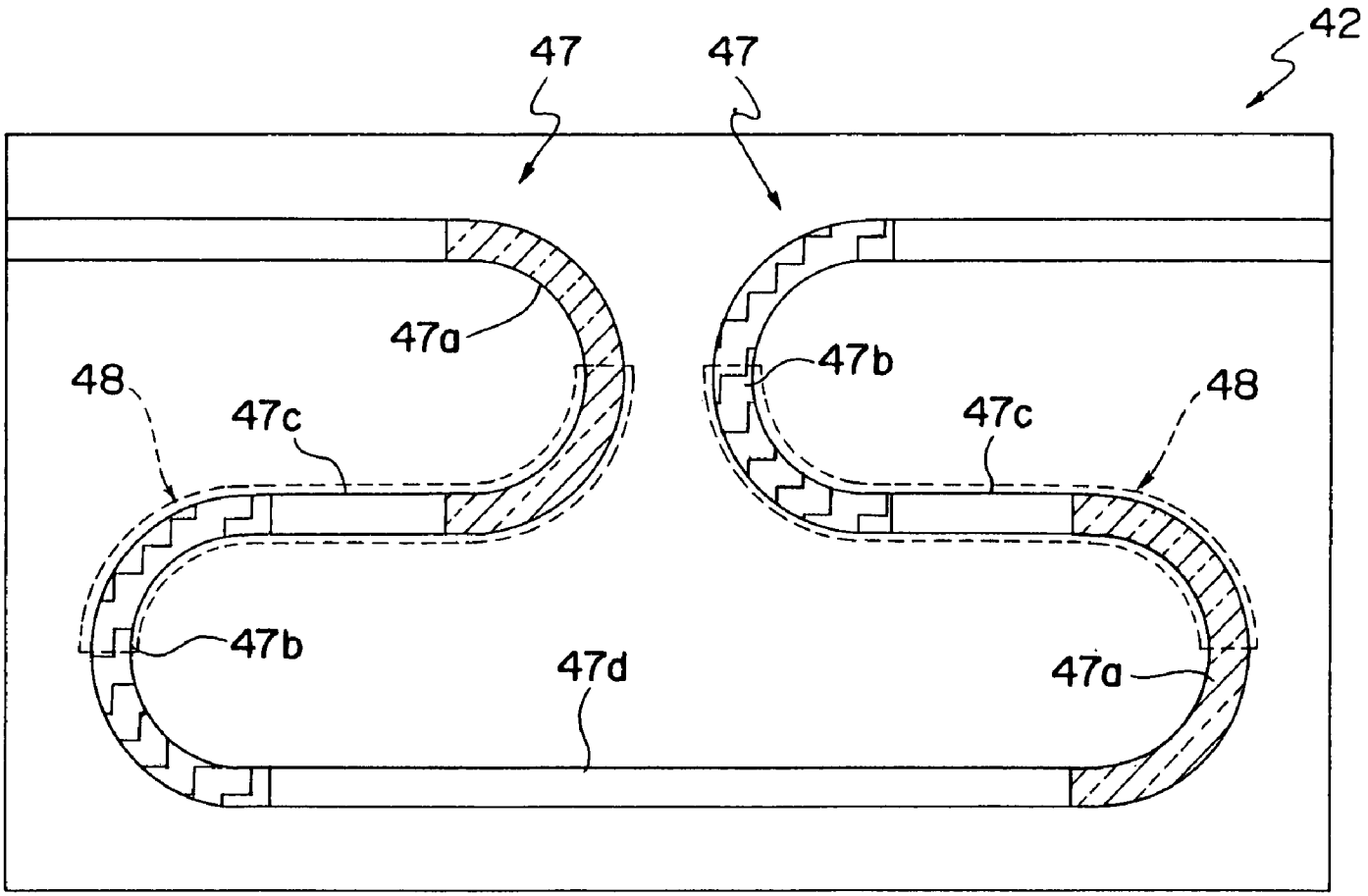
FIG. 6 is a schematic plan view of a transmission line according to a modification of the foregoing embodiment, showing a structure including a third signal conductor and a fourth signal conductor.

Also, in the transmission line 2 shown in FIG. 2A, the first signal conductor 7*a* and the second signal conductor 7*b* are connected directly to each other at the connecting portion 9. However, the transmission line according to this embodiment is not limited only to such a case. Instead of such a case, for example, the case may be that, like a transmission line 42 shown in a schematic plan view of FIG. 6, a first signal conductor 47*a* and a second signal conductor 47*b* are connected via a third signal conductor 47*c* which is an example of a conductor-to-conductor connection use signal conductor of a linear shape (or non-rotational structure) in a rotational-direction reversal structure 47. In this case, a midpoint of the third signal conductor 47*c* can be set as a rotational axis of 180-degree rotational symmetry. It is noted that in the transmission line 42 shown in FIG. 6, a transmission-direction reversal portion 48, which is a portion enclosed by broken line in the figure, is composed of part of the first signal conductor 47*a*, part of the second signal conductor 47*b*, and the entirety of the third signal conductor 47*c*.

Figure 7:
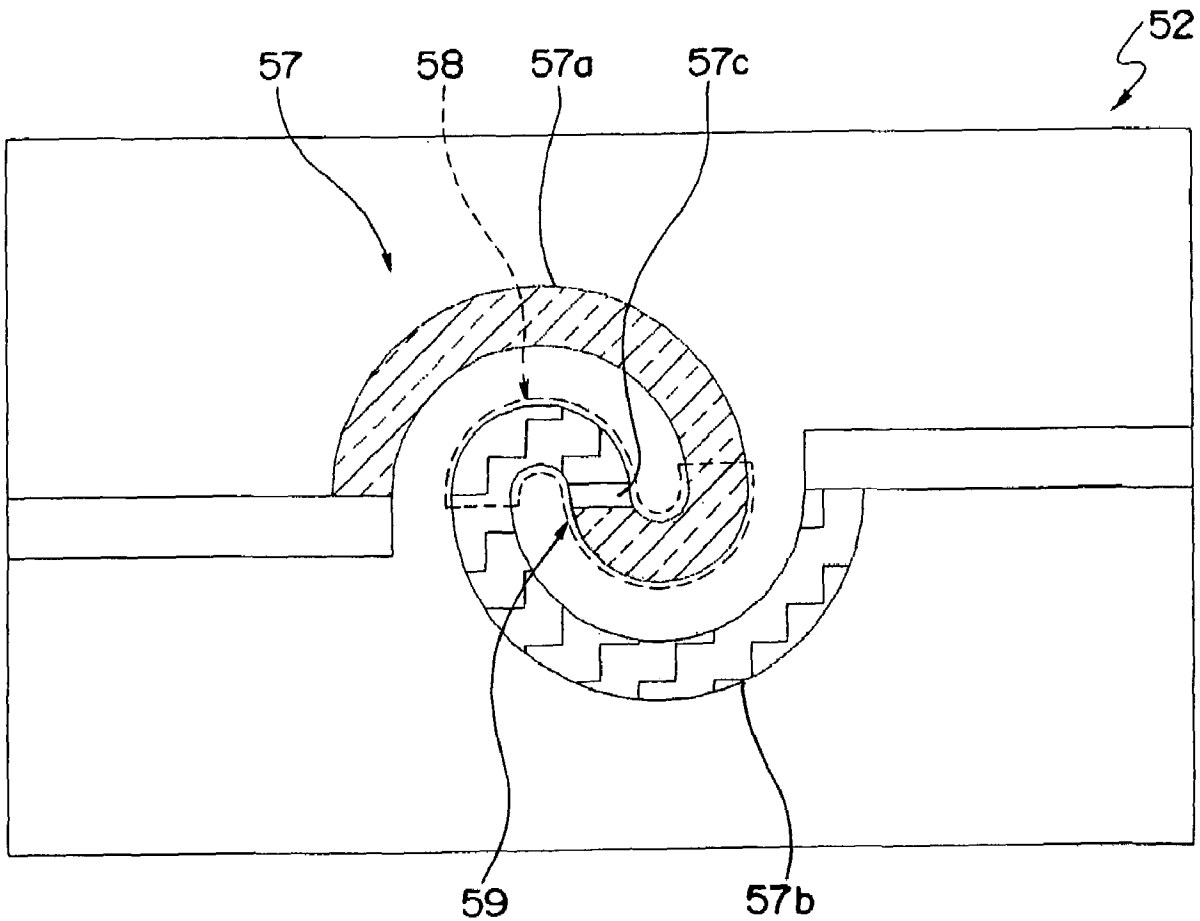
FIG. 7 is a schematic plan view of a transmission line according to a modification of the foregoing embodiment, showing a structure having a capacitor structure.

Also, the case where signal conductors are placed at the connecting portion 9 of the rotational-direction reversal structure 7 is not limitative. Instead of such a case, the case may be that, for example, in a rotational-direction reversal structure 57 of a transmission line 52, a dielectric 57*c* is placed at a connecting portion 59 for electrically connecting a first signal conductor 57*a* and a second signal conductor 57*b* to each other, as shown in FIG. 7, where the two signal conductors are connected to each other in a radio-frequency manner with a capacitor having such a capacitance value that a passing radio-frequency signal is allowed to pass therethrough. In such a case, the rotational-direction reversal structure 57 has a capacitor structure. It is noted that in the transmission line 52 of FIG. 7, a transmission-direction reversal portion 58, as enclosed by broken line in the figure, is composed of part of the first signal conductor 57*a*, part of the second signal conductor 57*b*, and the dielectric 57*c*.

Further, in the transmission line 12 shown in FIG. 3, adjacent rotational-direction reversal structures 7 are connected directly to one another without intervention of any other conductors. However, the case is not limited to such ones in which direct connection is provided. Instead of such a case, for example, like the transmission line 42 shown in FIG. 6, the case may be that adjacent rotational-direction reversal structures 47 are connected to one another via a fourth signal conductor 47*d*, which is an example of a structure-to-structure connection use signal conductor of a linear shape (or non-rotational structure or the like). Furthermore, although not shown, the case for such electrical connection between structures may be that a capacitor is formed with such a capacitance as to provide successful transit characteristics also to electromagnetic waves of the lower-limit frequency of a working band.

Also, the first signal conductor 7*a* and the second signal conductor 7*b*, which are formed each by making a signal conductor curved along a specified rotational direction, do not necessarily need to be spiral circular-arc shaped, but may also be formed by an addition of polygonal and rectangular wire lines, where the signal conductors are preferably formed so as to draw a gentle curve with a view to avoiding unwanted reflection of signals. Since a curved signal transmission path causes a shunt capacitance from a circuit's point of view, the case may be, for reduction of that effect, that the first signal conductor and the second signal conductor are fulfilled partly with their line width w narrower than the line widths of the third signal conductor and the fourth signal conductor.

Also, in one rotational-direction reversal structure, although the numbers of rotations Nr for the first signal conductor and the second signal conductor are not necessarily limited to identical ones in their setting, yet the numbers of rotations Nr are preferably set equal to each other. Further, instead of the case where the number of rotations Nr is considered in one rotational-direction reversal structure, the number of rotations Nr may be set so that a sum of total number of rotations Nr becomes a value close to 0 (zero) by taking into consideration a combination of the first signal conductor and the second signal conductor in one rotational-direction reversal structure as well as a combination of the first signal conductor and the second signal conductor in adjacently placed rotational-direction reversal structures in the one rotational-direction reversal structure, in which case also advantageous effects of the present invention can be obtained.

Also, as shown in FIGS. 2A and 3, whereas at least one or more rotational-direction reversal structures 7, each of which is composed of the first signal conductor 7*a*, the second signal conductor 7*b* and the connecting portion 9 and which includes the transmission-direction reversal portion 8 can obtain the effects of the present invention, it is more preferable, in particular, that a plurality of rotational-direction reversal structures 7 are arrayed.

In addition, when the rotational-direction reversal structures are connected to one another in series by a plurality of times in the transmission line of the present invention, a successful unwanted radiation suppression effect can be obtained by a placement that, as shown in FIG. 5 as an example, the second signal conductor 37*b* included in one rotational-direction reversal structure 37 and the first signal conductor 37*a* included in another one rotational-direction reversal structure 37 adjacent to the one rotational-direction reversal structure 37 have their rotational directions set opposite to each other.

Figure 8:
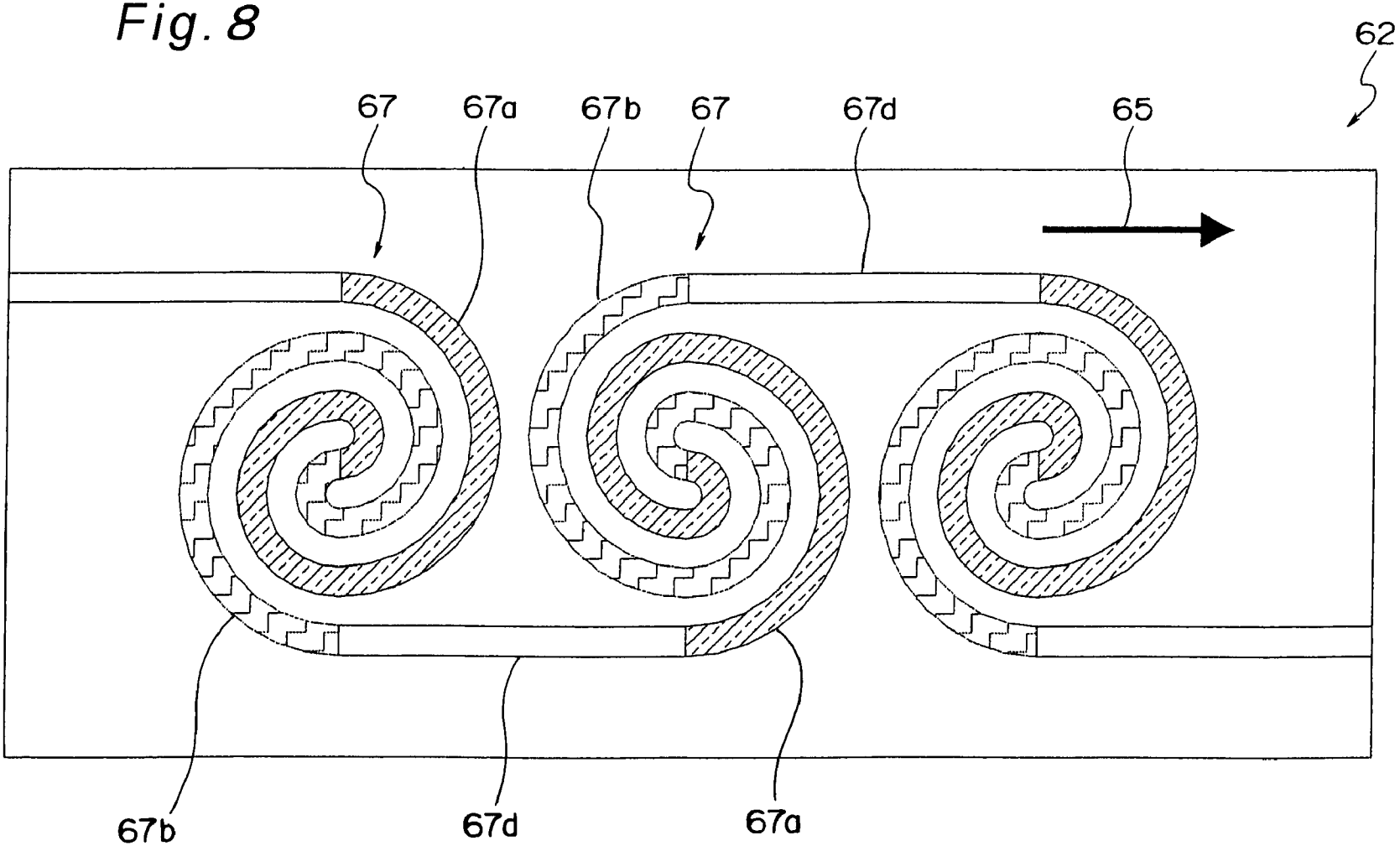
FIG. 8 is a schematic plan view of a transmission line according to a modification of the foregoing embodiment, showing a structure in which rotational directions of adjacent rotational direction reversal structures are set to mutually opposite directions.

Also, like a transmission line 62 shown in a schematic plan view of FIG. 8, adjacent rotational-direction reversal structures 67 may be connected to each other by using a fourth signal conductor 67*d* parallel to a signal transmission direction 65 so that a second signal conductor 67*b* included in the rotational-direction reversal structure 67 (placed at the left end in the figure) and a first signal conductor 67*a* included in its adjacent rotational-direction reversal structure 67 (placed in the center of the figure) have their rotational directions set to one identical rotational direction (i.e., second rotational direction R2).

Figure 9:
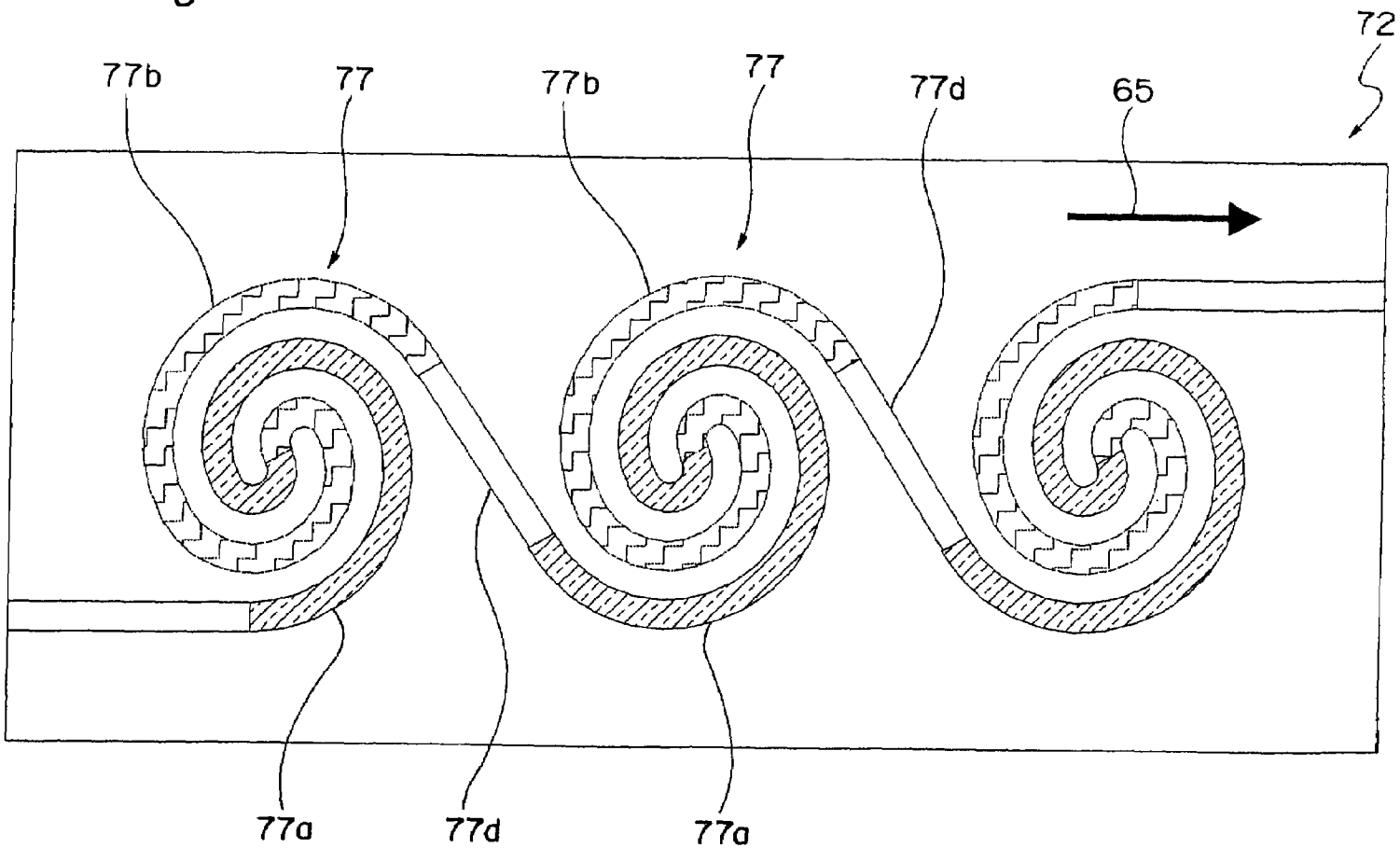
FIG. 9 is a schematic plan view showing a structure in which rotational directions of adjacent rotational-direction reversal structures are set to the same direction in the structure of the transmission line of FIG. 8.

Also, like a transmission line 72 of FIG. 9, a fourth signal conductor 77*d* may as well be placed not in parallel to the signal transmission direction 65 but in a skewed direction thereto. In addition, in a structure that the fourth signal conductor 77*d* for connecting adjacent rotational-direction reversal structures 77 to each other is formed into a generally linear shape and moreover placed in a direction skewed with respect to the signal transmission direction 65, the individual rotational-direction reversal structures 77 are placed in one identical placement configuration. In FIG. 9, the label 77*a* indicates the first signal conductor, and the label 77*b* indicates the second signal conductor.

Also, since it is not preferable that the phase of a transmission signal is rotated to an extreme extent during the transmission through the fourth signal conductor, the line length of the fourth signal conductor is preferably set to a line length less than one quarter of the effective wavelength at the frequency of the transmitted signal.

Also, with the use of the transmission line of the present invention, it is considered that two types of issues exist in relation to group delay frequency characteristics. The first issue is an increase in the total delay amount, and the second is a delay dispersion issue that the delay amount increases with increasingly heightening frequency. The first issue, the increase in total delay amount, is a fundamentally unavoidable issue with the use of the transmission line of the present invention. However, the degree of increase in delay amount due to increasing of line length in the transmission line of the present invention amounts to at most a few percent to several tens percent, as compared with conventional transmission lines, such that this level of increase in delay amount does not matter for practical use.

As to the second issue, the delay dispersion that may cause the delay amount to increase with increasingly heightening frequency of transmission band and cause the transmission pulse shape to collapse can easily be avoided. This is an issue which occurs when each site within the structure of the present reaches an electrical length that cannot be neglected with respect to the effective wavelength of the electromagnetic wave. Generally, for the transmission line structure of a planar radio-frequency circuit, a transmission line of the same equivalent impedance can be fulfilled by maintaining a ratio of line width to substrate thickness, and therefore, the total line width is reduced more and more as the substrate thickness is set increasingly thinner. Accordingly, the electrical length of each portion also becomes negligible with respect to the effective wavelength, so that the issue of delay dispersion as the second issue can be solved without lessening the advantageous effects of the invention.

Figure 10A:
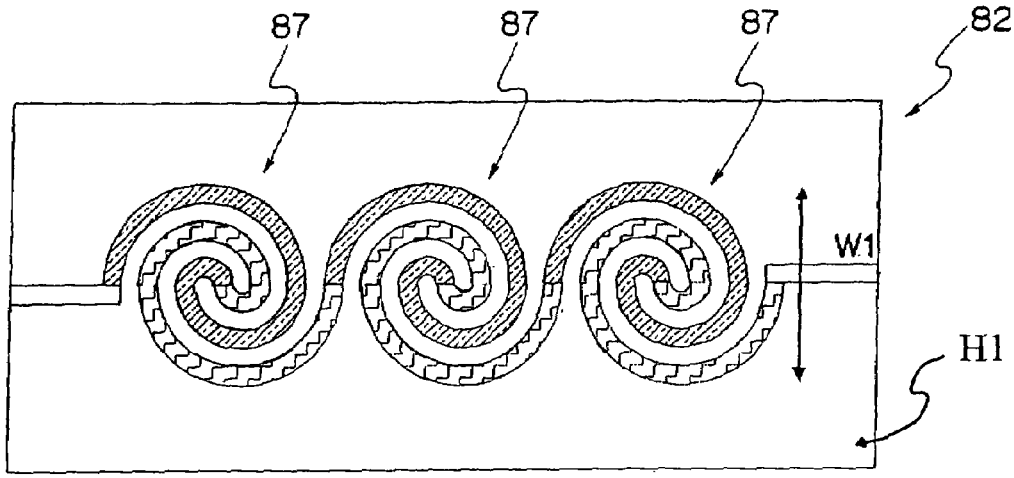
FIG. 10A is a schematic plan view of a transmission line according to a modification of the foregoing embodiment, showing a structure in which the dielectric substrate is set thick.
Figure 10B:
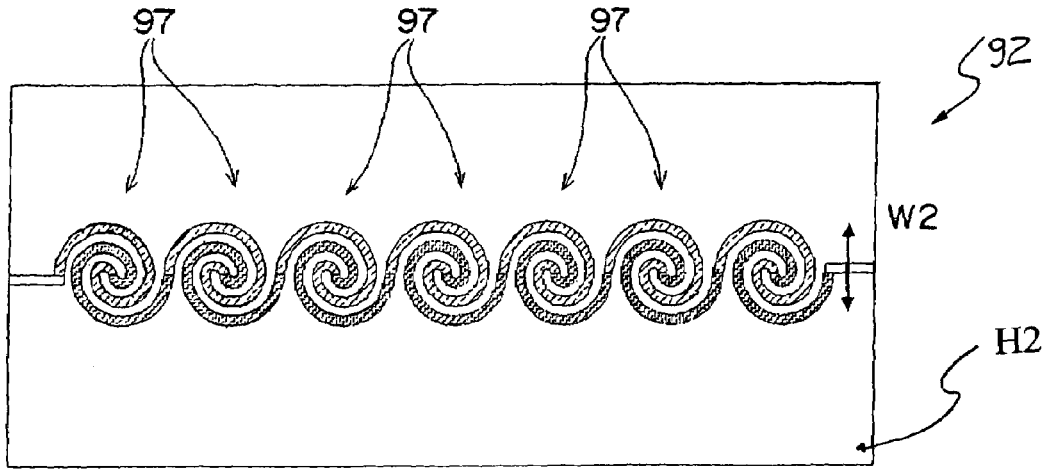
FIG. 10B is a schematic plan view showing a structure in which the dielectric substrate is set thinner as compared with the transmission line of FIG. 10A.

Now, as an example, a schematic plan view of a transmission line 82 in the case where the structure of the transmission line of the present invention is formed on a dielectric substrate having a large substrate thickness H1 is shown in FIG. 10A, while a schematic plan view of a transmission line 92 in the case where the transmission line of the present invention is formed on a dielectric substrate having a small substrate thickness H2 is shown in FIG. 10B, where a comparison is made between the two cases. In the transmission line 82 shown in FIG. 10A, since the total line width W1 is set large, each portion including a rotational-direction reversal structure 87 becomes large. By contrast, in the transmission line 92 shown in FIG. 10B, since the total line width W2 (W2<W1) is set small due to a reduction in the circuit board thickness, where it can be understood that the electrical length of each of the individual circuit-constituting sites including the transmission-direction reversal structure 97 is reduced. This indicates that the more the trend toward higher-density wiring that involves thinner circuit structures and finer wiring widths advances, the more the upper-limit frequency of the transmission band that can be managed by the transmission line structure of the present invention can be improved.

Next, it will be explained that adopting the transmission line of this embodiment has advantageous effects over conventional transmission lines in terms of unwanted radiation suppression, and conditions to be adopted therefor are also described.

Figure 19:
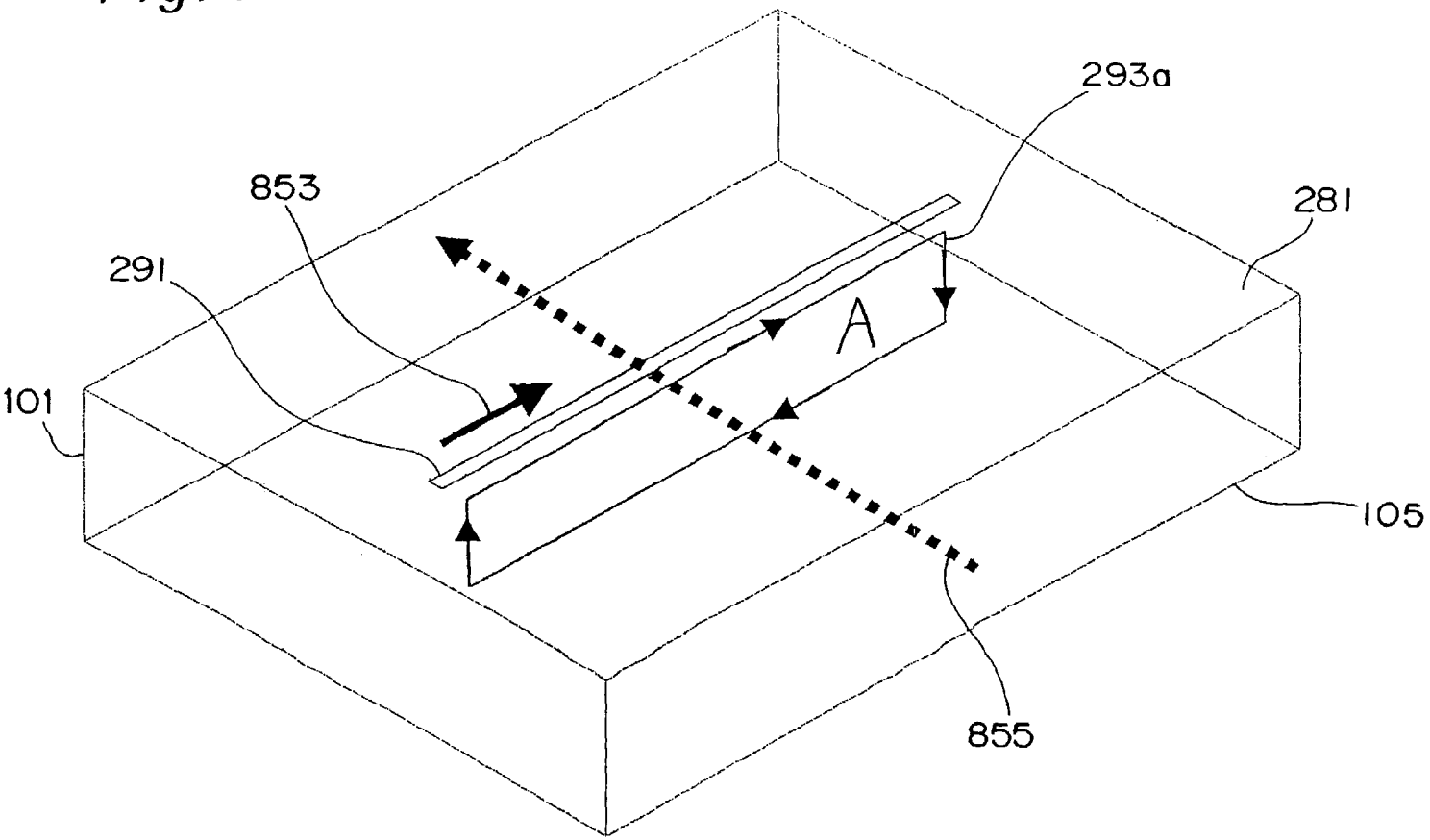
PRIOR ART Fig. 19
FIG. 19 is a schematic explanatory view for explaining a cause of unwanted radiation in a conventional transmission line.

The reason of increases in the intensity of unwanted radiation derived from a conventional transmission line shown in FIG. 19 can be considered that because of formation of a long current loop 293*a* continuing over a lengthwise direction of the transmission line, a radio-frequency magnetic field 855 interlinking with the resulting current loop is directed in one direction in continuation and moreover that the loop area of the resulting current loop cannot be maintained at a small value. Now a planar schematic explanatory view of the transmission line 2 of this embodiment explained with reference to FIGS. 2A and 2B is shown in FIG. 11, and a radio-frequency magnetic field occurring in the case where a radio-frequency current is transmitted along the transmission line 2 is explained below with reference to the schematic explanatory view of FIG. 11.

Figure 11:
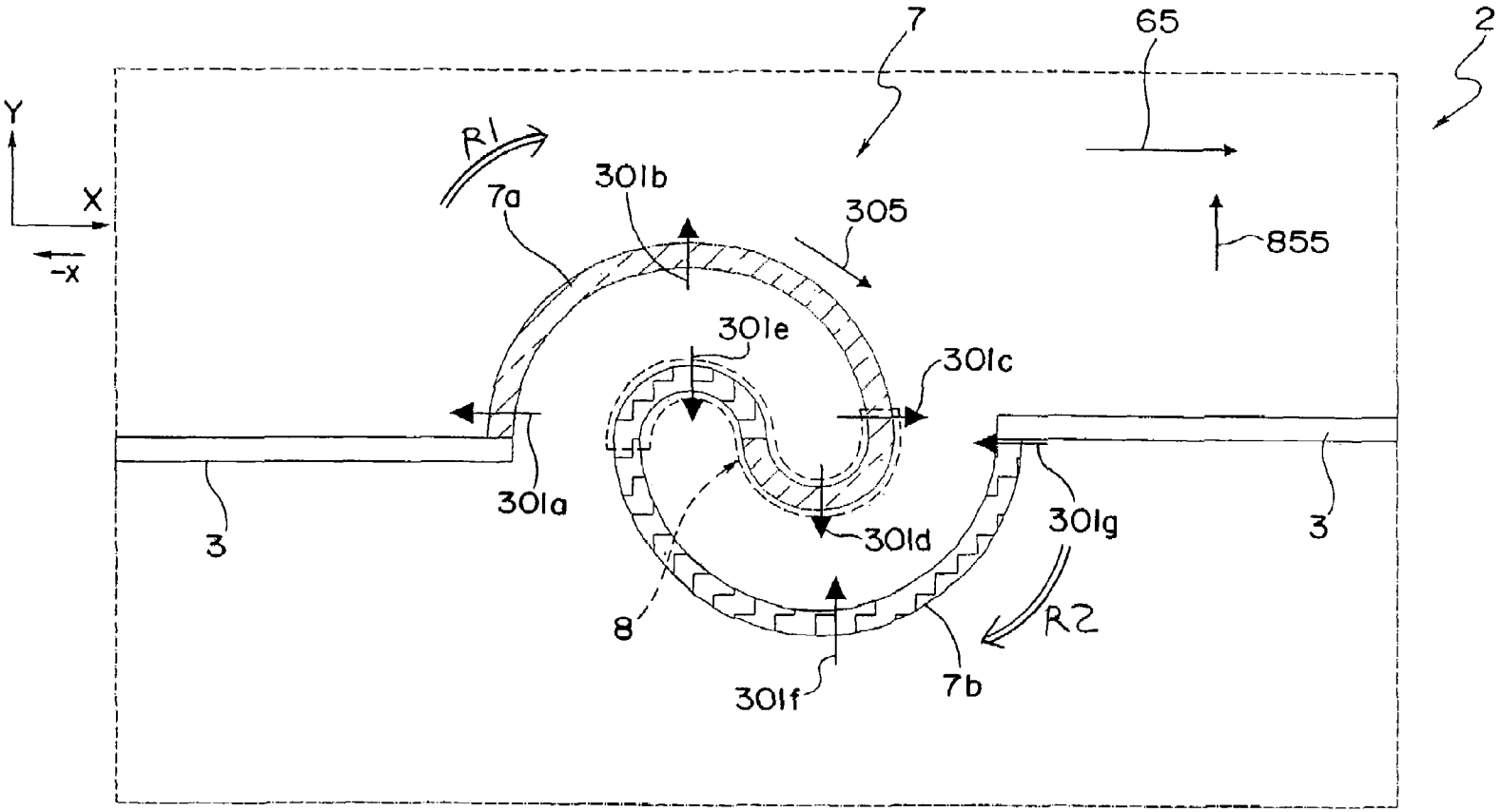
FIG. 11 is a schematic explanatory view showing the directions of local magnetic fields in the rotational-direction reversal structure in the transmission line of the foregoing embodiment.

As shown in FIG. 11, in the transmission line 2, for example, one rotational-direction reversal structure 7 with the number of rotations Nr set to 1 rotation is formed one in number. In this transmission line 2, as a radio-frequency current 305 is let to travel along a direction (signal transmission direction) identical by arrow 65, i.e., from the left to the right side as a whole transmission line, the radio-frequency current 305 is transmitted at a local portion in the rotational-direction reversal structure 7 in a direction different from the signal transmission direction 65. That is, since the rotational-direction reversal structure 7 is composed of the first signal conductor 7*a* curved along the first rotational direction R1 and the second signal conductor 7*b* curved along the second rotational direction R2, the placement direction of the signal conductor is changed at local portions, so that the direction of the transmitted current 305 is changed in a minute cycle. As a result of the change in the direction of the transmitted radio-frequency current 305 as shown above, radio-frequency magnetic fields are generated in various directions 301*a*, 301*b*, 301*c*, 301*d*, 301*e*, 301*f* and 301*g* at local portions in the rotational-direction reversal structure 7.

Thus, by the directions 301*a*-301*g* of the radio-frequency magnetic fields being changed into various directions, an aggregate of locally segmented small-area current loops are generated in the rotational-direction reversal structure 7 so that an enormous current loop, which would be continuous over the entire line length in conventional transmission lines, is locally segmented. As shown in FIG. 11, for example, radio-frequency magnetic fields 301*d*, 301*e* can be generated in directions opposite to, i.e. rotated by 180 degrees from, the directions of radio-frequency magnetic fields 301*b*, 301*f* generated in a direction 855 similar to that of conventional transmission lines. Further, radio-frequency magnetic fields 301*a*, 301*g* can be generated in directions opposite to the direction of a radio-frequency magnetic field 301*c* generated in the same direction as the signal transmission direction 65. Thus, radio-frequency magnetic fields can be generated in various directions within the rotational-direction reversal structure 7, by which an unwanted radiation reduction effect can be obtained.

In particular, in the transmission line 2 of FIG. 11, by the inclusion of a portion (transmission-direction reversal portion 8) where the radio-frequency current 305 is passed locally in a direction opposite to the signal transmission direction 65, components that mutually cancel out radio-frequency magnetic fields generated in the transmission line can be generated, so that the unwanted radiation reduction effect can be obtained more effectively. More specifically, the transmission line 2 of FIG. 11 is so structured that, in a signal conductor forming another transmission-direction reversal portion 8 having a larger curvature of its curve placed inside the rotational-direction reversal structure 7, the radio-frequency current 305 flows along a direction opposite to the signal transmission direction 65, i.e., the signal transmission direction is reversed with respect to the signal transmission direction 65, where this reversal portion is the transmission-direction reversal portion 8. Herein, the terms, "reverse the signal transmission direction," mean that with the signal transmission direction 65 assumed as the X-axis direction and a direction orthogonal to the X-axis direction assumed as the Y-axis direction as shown in FIG. 11, a vector representing the direction of a signal transmitted in the signal conductor is made to have at least a −x component generated therein.

Like this, it is a preferable condition for the transmission line of the present invention to meet a condition that local radio-frequency magnetic fields are generated in directions reversed by more than 90 degrees, more preferably in a completely reversed direction (180-degree direction), from the magnetic-field direction 855 in conventional transmission lines. If the number of rotations Nr of the rotational-direction reversal structure is set to a value larger than 0.5, then a signal conductor that locally transmits a signal in a direction different from the signal transmission direction 65 by 90 degrees or more is necessarily generated, thus allowing the above condition to be easily met.

Also with the number of rotations Nr set to 0.5, the condition can be met by introducing a third signal conductor or a fourth signal conductor. For example, directions of radio-frequency magnetic fields generated in transmission lines 322, 332 made up, for example, by adding a fourth signal conductor with the number of rotations Nr=0.5 are shown in schematic explanatory views of FIGS. 12 and 13.

Figure 12:
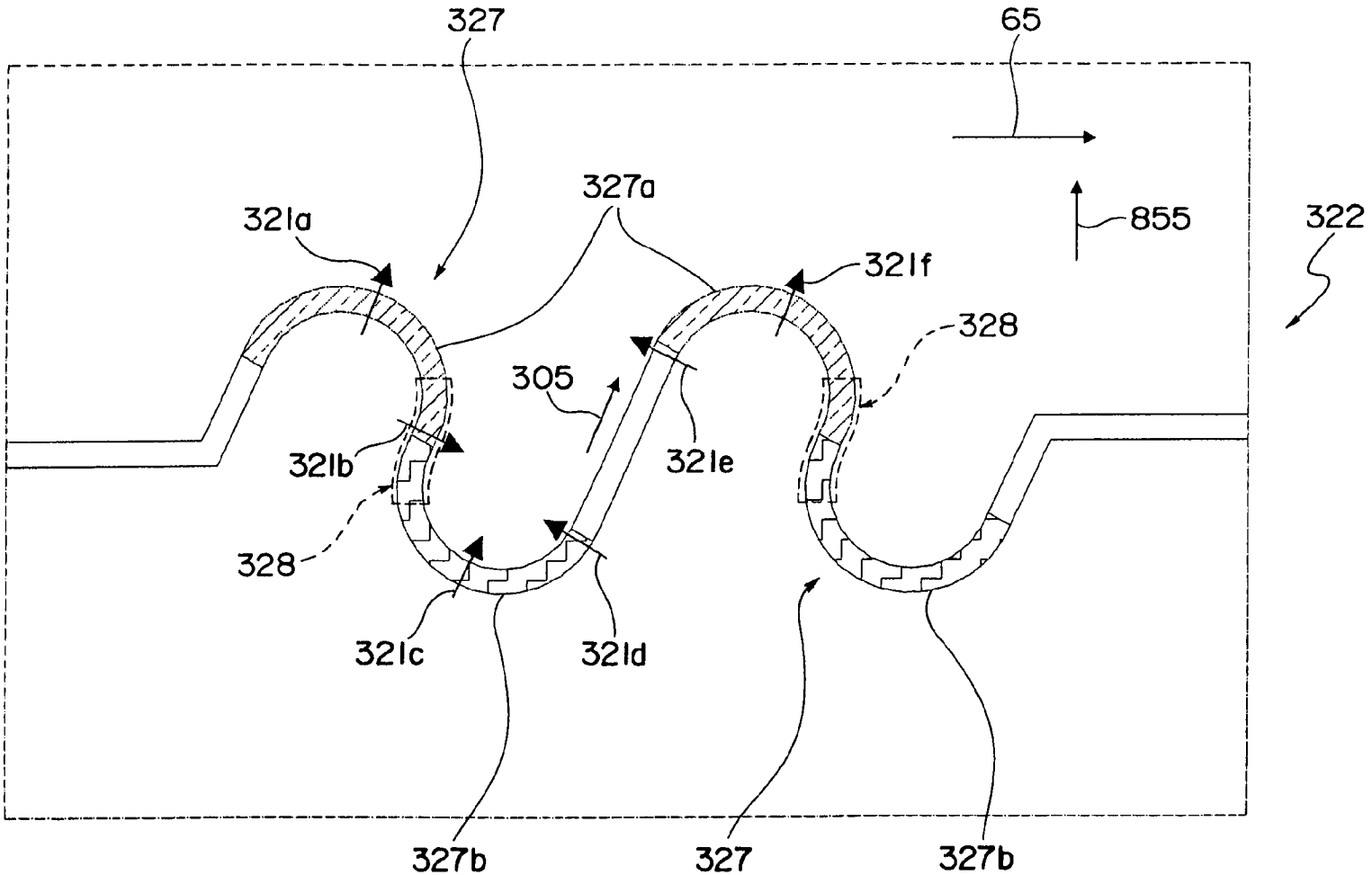
FIG. 12 is a schematic explanatory view showing the directions of local magnetic fields in a transmission line which is different in structure from the transmission line of FIG. 11.
Figure 13:
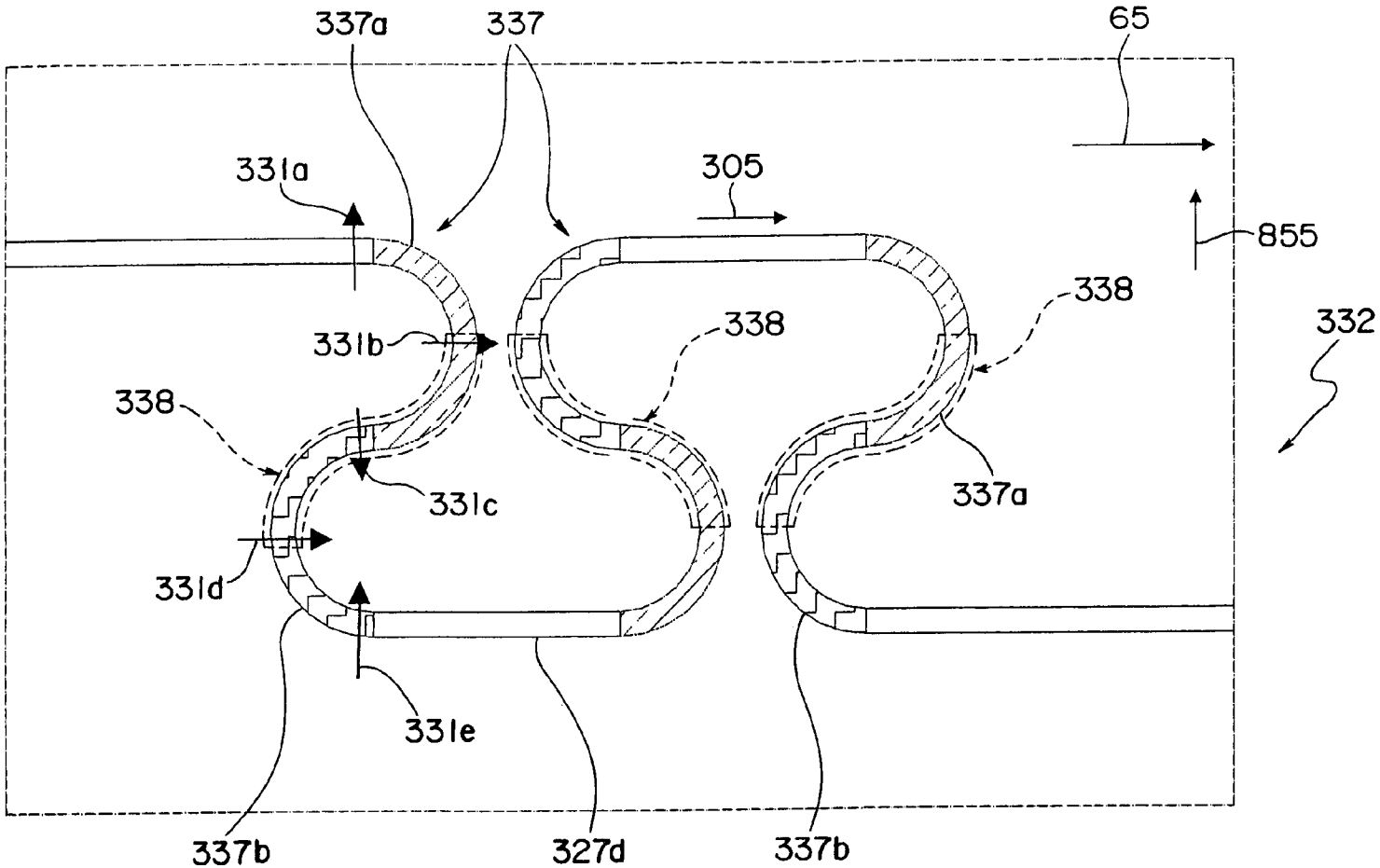
FIG. 13 is a schematic explanatory view showing the directions of local magnetic fields in a transmission line having a still another structure.

As apparent from the schematic explanatory views of FIGS. 12 and 13, it can be understood that the direction of locally generated radio-frequency magnetic fields can be changed to a considerable extent even in the transmission line having the number of rotations Nr=0.5. More specifically, in the transmission line 322 shown in FIG. 12, by introducing a fourth signal conductor 327*d* located between a second signal conductor 327*b* in one rotational-direction reversal structure 327 and a first signal conductor 327*a* in its adjacent rotational-direction reversal structure 327, a magnetic field 321*b* in a transmission-direction reversal portion 328, which is a portion enclosed by broken line, among the directions of radio-frequency magnetic fields 321*a*, 321*b*, 321*c*, 321*d*, 321*e*, and 321*f* generated at local portions has a component directed opposite to the magnetic-field direction 855 of the conventional transmission line. Further, in the transmission line 332 shown in FIG. 13, similarly, by introduction of the fourth signal conductor 327*d* for connecting adjacent rotational-direction reversal structures 337 to one another, a direction opposite to the magnetic-field direction 855 of the conventional transmission line can reliably be generated at a magnetic field 331*c* near a center of a transmission-direction reversal portion 338 among the directions of radio-frequency magnetic fields 331*a*, 331*b*, 331*c*, 331*d*, and 331*e* generated at local portions. In any of the transmission lines 322 and 332, since a constitution including the transmission-direction reversal portions 328, 338 is adopted, a magnetic field having a component directed opposite to the magnetic-field direction 855 of the conventional transmission line can be generated in the transmission-direction reversal portions 328, 338, so that the unwanted radiation reduction effect of the present invention can be provided more effectively. That is, to suppress the unwanted radiation intensity, it is preferable to adopt a constitution that the signal is transmitted locally toward a direction different from the signal transmission direction 65 by more than 90 degrees at, at least, one portion among the first, second, third and fourth signal conductors, i.e., a constitution including the transmission-direction reversal portion.

Further, although such an unwanted radiation intensity suppression effect is enhanced by setting the number of rotations Nr of the rotational-direction reversal structure to a large value, yet there is a tendency that the effect is saturated when Nr reaches about 2. Also, extremely large settings of Nr would incur increases of the total wiring region width W in the transmission line as well as of the circuit occupation area, hence undesirable. Besides, the unwanted radiation intensity suppression effect described with reference to the schematic explanatory views of FIGS. 11 to 13 can be obtained under the condition that the phase of the radio-frequency current is not rotated to any extreme extent which is the structure of the shown transmission line. That is, any setting of the line length of the rotational-direction reversal structure to such a value as to cause resonance at the frequency of the transmitted signal is undesirable because it incurs both transmission characteristics deterioration and unwanted radiation. From the above conditions, setting the number of rotations Nr to an extremely large value is also undesirable and, conversely, setting the number of rotations Nr to a value of 2 or less allows the unwanted radiation suppression effect of the present invention to be obtained enough without limiting the upper-limit value for the band in use. Therefore, from the viewpoint of obtaining the unwanted radiation intensity suppression effect, it is preferable, as an ordinary practical condition, that the number of rotations Nr of the rotational-direction reversal structure is within a range from 0.75 to 2. In FIG. 12 and FIG. 21, the label 65 indicates the signal transmission direction. In FIG. 13, the label 337*a* indicates the first signal conductor, and the label 337*b* indicates the second signal conductor.

Further, in the transmission line of the present invention, connecting rotational-direction reversal structures in series to a plurality of times is preferable for the unwanted radiation intensity reduction. In particular, in the transmission line of the present invention, there can be obtained an effect increasing phenomenon of unwanted radiation suppression which depends on the effective line length and which is not obtained in the conventional transmission line. That is, in the conventional transmission line, since the current loop is continuous over the line length, there is a tendency that the unwanted radiation intensity monotonously increases with increasing line length. For instance, even if unwanted radiation intensity derived from a transmission line having a certain line length is observed, a phenomenon that the intensity is reduced at such a frequency that the effective line length corresponds to 0.5 or 1 time the effective wavelength is not particularly seen. On the other hand, in the transmission line of the present invention, setting an effective line length Leff to 0.5 time or more the effective wavelength of a frequency component at which reduction of unwanted radiation is desired makes it possible to effectively suppress the unwanted radiation intensity. Elongating the line length so that the effective line length Leff becomes equal to the effective wavelength at a frequency at which suppression of unwanted radiation intensity is desired makes it possible to obtain the most possible unwanted radiation intensity suppression effect.

Since the current loop is locally cut off in the transmission line of the present invention, one unwanted radiation that occurs due to a magnetic field at any arbitrary local portion and another unwanted radiation that occurs due to a magnetic field at a local portion having a phase rotated by one half of the effective wavelength along the transmission line can be canceled out by each other. Therefore, with the effective line length Leff reaching 0.5 time or more the effective wavelength, an enhanced unwanted radiation suppression effect can be obtained.

Furthermore, under the condition that the effective line length Leff reaches 1 time the effective wavelength, enormous numbers of local magnetic fields generated in a region having a line length corresponding to one half of the effective wavelength are completely opposite in direction to local magnetic fields generated at portions whose phases are rotated by one half of the effective wavelength, respectively, so that unwanted radiations that occur due to the two magnetic fields are necessarily canceled out, thus making it possible to obtain the most possible unwanted radiation suppression effect.

Further, even if the line length is elongated, unwanted radiations that occur from line lengths corresponding to integral multiples of the effective wavelength keep at least completely canceled out, so that the unwanted radiation suppression effect of the present invention is never lost. From the above-described principle, for the transmission line of the present invention, when the effective line length Leff is set to 0.5 time or more, particularly preferably 1 time or more, the effective wavelength of a frequency component at which reduction of unwanted radiation is desired, it becomes implementable to suppress the unwanted radiation intensity to a great extent as compared with the conventional transmission line.

Also, as the structure within the rotational-direction reversal structure, it is preferable to satisfy the following condition. Whereas the first signal conductor and the second signal conductor in one aspect have their directions of the curves set to opposite directions as the first rotational direction R1 and the second rotational direction R2, it is preferable that other conditions including configuration, number of rotations Nr and line width w are set as equivalent as possible to each other. This is aimed at avoiding occurrence of unwanted radiation due to an asymmetry local structure within the transmission line. This condition can be satisfied by an arrangement that the first signal conductor and the second signal conductor are in 180-degree rotational symmetry (i.e. point symmetry) while an axis set within the rotational-direction reversal structure is taken as a rotational axis (center) as described above.

Figure 14:
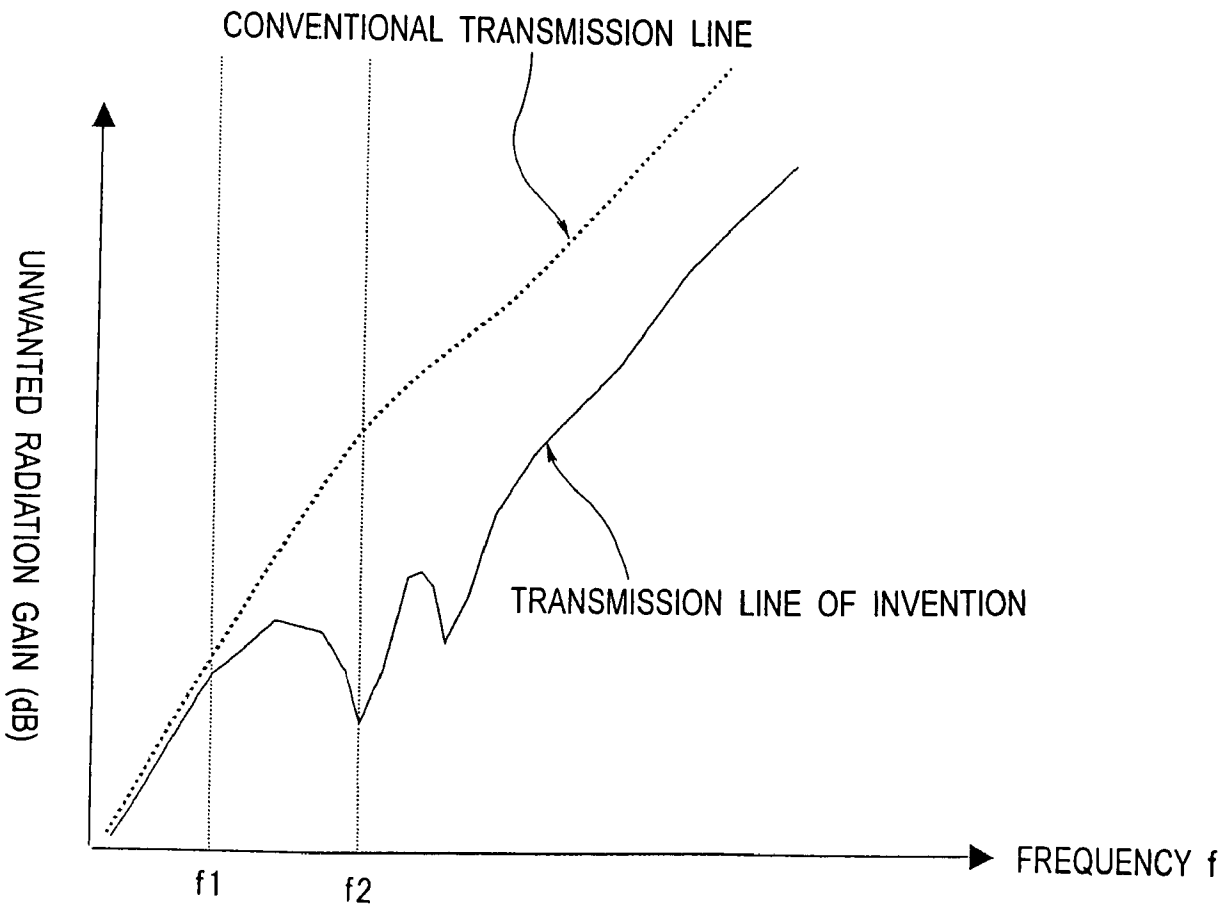
FIG. 14 is a schematic view in the form of a graph showing, in comparison, the frequency characteristics of unwanted radiation gain characteristics between a transmission line which is an example of the present invention and a conventional transmission line.

Now, FIG. 14 shows, in a schematic view in the form of a graph, a comparison of unwanted radiation characteristics between a transmission line of this embodiment and a conventional transmission line. It is noted that in FIG. 14, the vertical axis represents unwanted radiation gain (dB) versus input power and the horizontal axis represents frequency (in logarithmic expression), where the transmission line of this embodiment is expressed in solid line and the conventional transmission line is expressed in dotted line. In addition, for the transmission line of the embodiment, with the number of rotations Nr within the rotational-direction reversal structure set to a value of about 1, typical characteristics resulting from a case where the rotational-direction reversal structure is set over the line length without interruption are shown schematically. Also, substrate conditions and effective characteristic impedances of the two transmission lines in comparison are set equal to those of the transmission line of the Prior Art Example, where their line length is 15 mm. Besides, the comparison is made on a setting that both ends of all the lines in comparison are terminated by the same impedance as the characteristic impedance of the transmission line, and the comparison of unwanted radiation intensity is not conditioned by the use of the two transmission lines as resonators. Further, as the unwanted radiation gain, gains observed in a direction of the highest intensity are plotted.

As shown in FIG. 14, the transmission line of this embodiment shows unwanted radiation intensities relatively close to those of the conventional transmission line in a region of lower frequencies f, where the effect of unwanted radiation intensity reduction is about 0.5 dB. Meanwhile, as the frequency goes higher than a certain frequency f1, the unwanted radiation suppression effect is enhanced. Then, the unwanted radiation suppression effect reaches a maximum at a frequency f2 (f2>f1). Although slightly varying in frequency regions of f>f2, the improvement effect is sustained. The transit phase amount between both ends of the transmission line of this embodiment corresponds to 180 degrees at the frequency f1, and is 360 degrees at the frequency f2.

Figure 15:
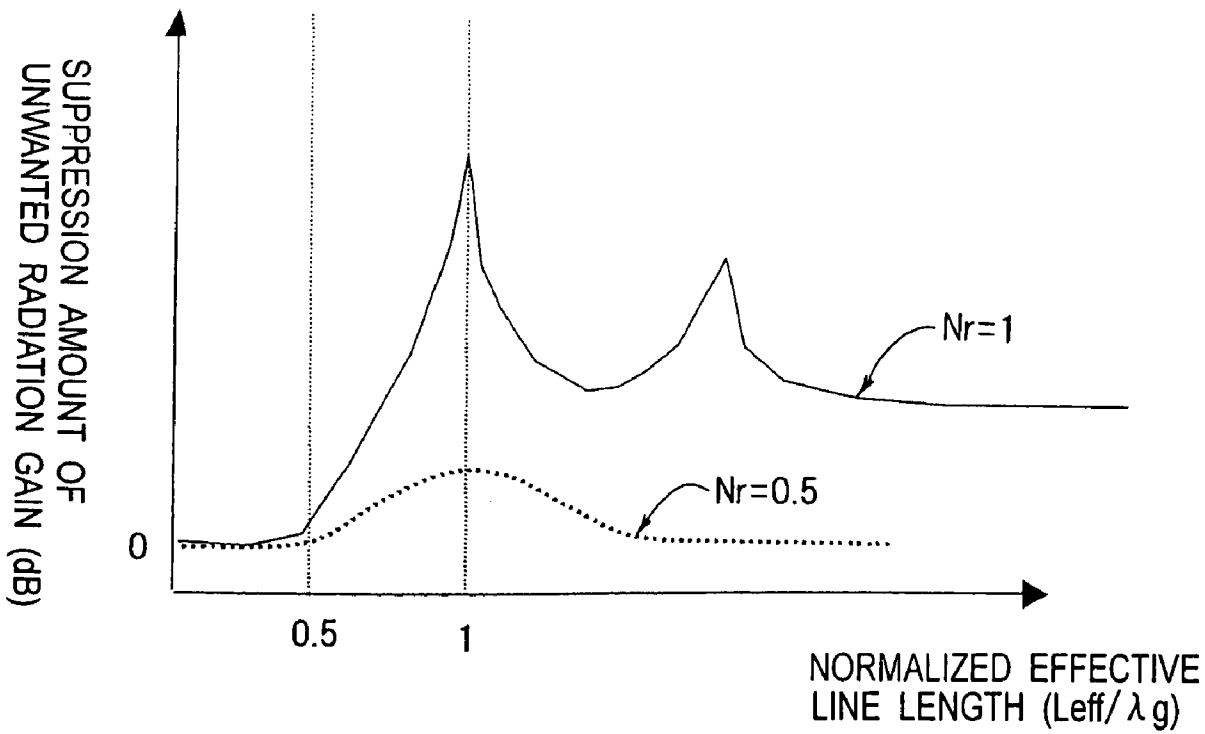
FIG. 15 is a schematic view in the form of a graph showing effective line length dependence of the unwanted radiation suppression effect by a transmission line which is an example of the present invention.

Next, FIG. 15 shows a schematic replot of the results of FIG. 14 by using the transmission line of this embodiment having a number of rotations Nr of about 1, where the vertical axis represents the suppression amount of unwanted radiation gain or intensity in comparison with the conventional transmission line having the equal line length and the horizontal axis represents values resulting from normalizing the effective line length of the transmission line of this embodiment derived from transit phase values by effective wavelengths at individual frequencies. That is, in FIG. 15, a state of 0.5 in the horizontal axis corresponds to a case where the effective line length Leff is one half of the effective wavelength and a state of 1 in the horizontal axis corresponds to a case where the effective line length Leff is 1 time the effective wavelength. In addition, characteristics of the transmission line of this embodiment with the number of rotations Nr=0.5, which is not plotted in FIG. 14, are also plotted additionally in FIG. 15.

As shown in FIG. 15, the unwanted radiation intensity suppression effect starts at 0.5 in the horizontal axis, proving that the value of 0.5 does not depend on the number of rotations Nr. Also, the unwanted radiation suppression effect is maximized at 1 in the horizontal axis, where the value of 1 as well does not depend on the number of rotations Nr. Meanwhile, for 1 or more in the horizontal axis, characteristics are conditioned considerably by differences of the number of rotations Nr. With the number of rotations Nr=1, the unwanted radiation suppression effect is not lost but sustained even if an elongation over 1 is made in the horizontal axis. Meanwhile, with the number of rotations Nr=0.5, indeed unwanted radiation is never increased over the conventional transmission line, but the suppression effect goes toward convergence with increasing line length, thus it being difficult to obtain the unwanted radiation suppression effect over a wide condition. In order that the unwanted radiation suppression effect is obtained over a wide condition range, it is of importance that the number of rotations takes a value more than 0.5.

In the above description, the number of rotations Nr is mentioned as a parameter of the transmission line of this embodiment. However, as described above, the number of rotations Nr is a parameter showing how the current loop of the transmission line is segmented. Therefore, by setting the local orientation of the signal conductor so as to be slanted by 90 degrees or more to the signal transmission direction by using the third and fourth signal conductors makes it possible to increase the effect for unwanted radiation even with the number of rotations Nr set to a small value.

Working Examples

Next, several working examples of the transmission line of this embodiment will be described below.

As working examples, a signal conductor having a thickness of 20 μm and a line width of 75 μm was formed by copper wiring on a top face of a dielectric substrate having a dielectric constant of 3.8 and a total thickness of 250 μm, and a grounding conductor layer having a thickness of 20 μm was formed all over on a rear face of the dielectric substrate similarly by copper wiring, by which a microstrip line structure was made up. With the total wiring region width W set to 500 μm, the first signal conductor and the second signal conductor were formed so as to be curved with a number of rotations Nr within the rotational-direction reversal structure. A transmission line having a rotational-direction reversal structure whose number of rotations Nr of the signal conductor was 0.75 rotation and a transmission-direction reversal portion was fabricated as Working Example 1 of the present invention, and a transmission line having a rotational-direction reversal structure whose number of rotations Nr was 1 rotation and a transmission-direction reversal portion was fabricated as Working Example 2. Further, a transmission line having a rotational-direction reversal structure with an Nr of 0.5 rotation but not having a transmission-direction reversal portion was fabricated as Comparative Example against those Working Examples 1 and 2. In addition, the line width of the transmission line of Comparative Example was set to 100 μm so that the total wiring region width W would become 500 μm in the transmission lines of Working Examples 1 and 2 and Comparative Example. Also, a structure that rotational-direction reversal structures were connected to one another in 24 cycles was adopted in the transmission line of Working Example 1, a structure that the rotational-direction reversal structures were connected in 21 cycles was adopted in the transmission line of Working Example 2, a structure that the rotational-direction reversal structures were connected continuously in 27 cycles was adopted in the transmission line of Comparative Example, and furthermore the transmission lines were fabricated with their respective line lengths set to 15 mm.

Figure 16:
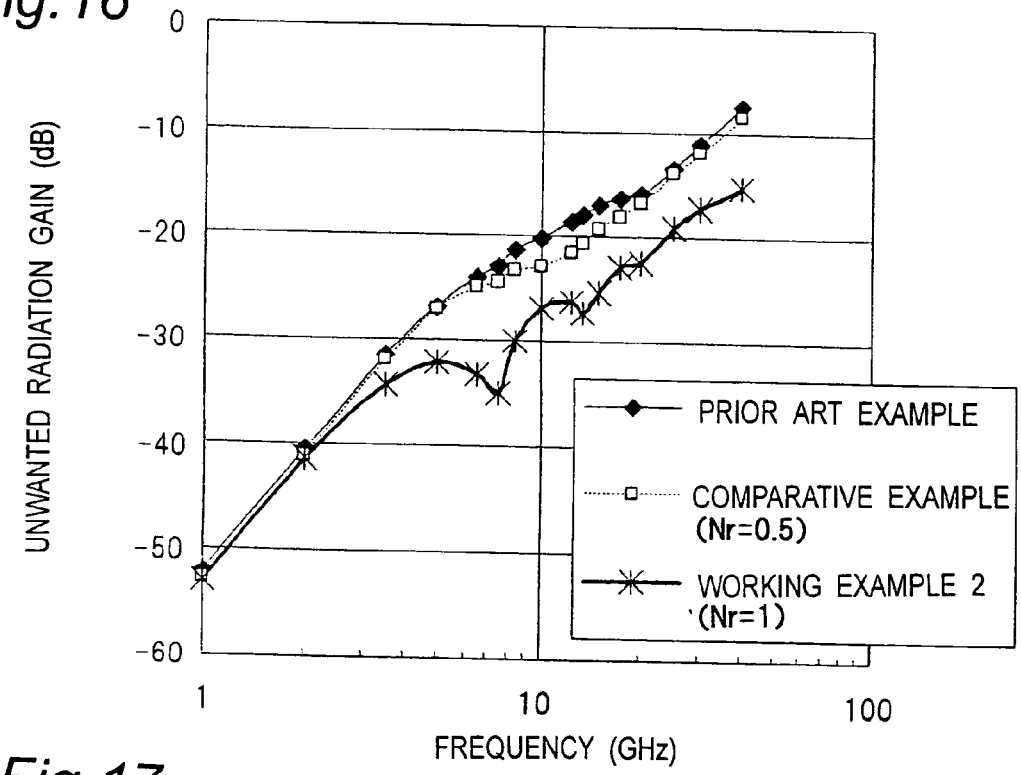
FIG. 16 is a view showing the frequency dependence of radiated unwanted radiation intensity in a transmission line of Working Example 2 of the present invention, a transmission line of Comparative Example, and a transmission line of Prior Art Example.

The transmission lines of these Working Examples 1 and 2 and Comparative Example were subjected to measurement of unwanted radiation intensity. As a result of the measurement, FIG. 16 shows the frequency dependence of unwanted radiation intensity derived from Comparative Example (number of rotations Nr=0.5) and Working Example 2 (number of rotations Nr=1). In addition, characteristics in the conventional transmission line having the same wire number and density and the same line length were added in FIG. 16 for use of comparison with the linear transmission line of conventional construction. It is noted that the unwanted radiation intensity is shown as antenna gain against input power and the horizontal axis represents logarithmic expression of frequency. As shown in FIG. 16, whereas the transmission lines of both Comparative Example and Working Example 2 showed unwanted radiation gains lower than that of the transmission line of Prior Art Example at all times, it was verified that Comparative Example (Nr=0.5) yielded a unwanted radiation suppression effect slightly stronger than that of Prior Art Example only in a frequency range from 6 GHz to 25 GHz while Working Example 2 (Nr=1) can obtain particularly strong unwanted radiation suppression effects over the entire frequency range of 3 GHz or higher.

Figure 17:
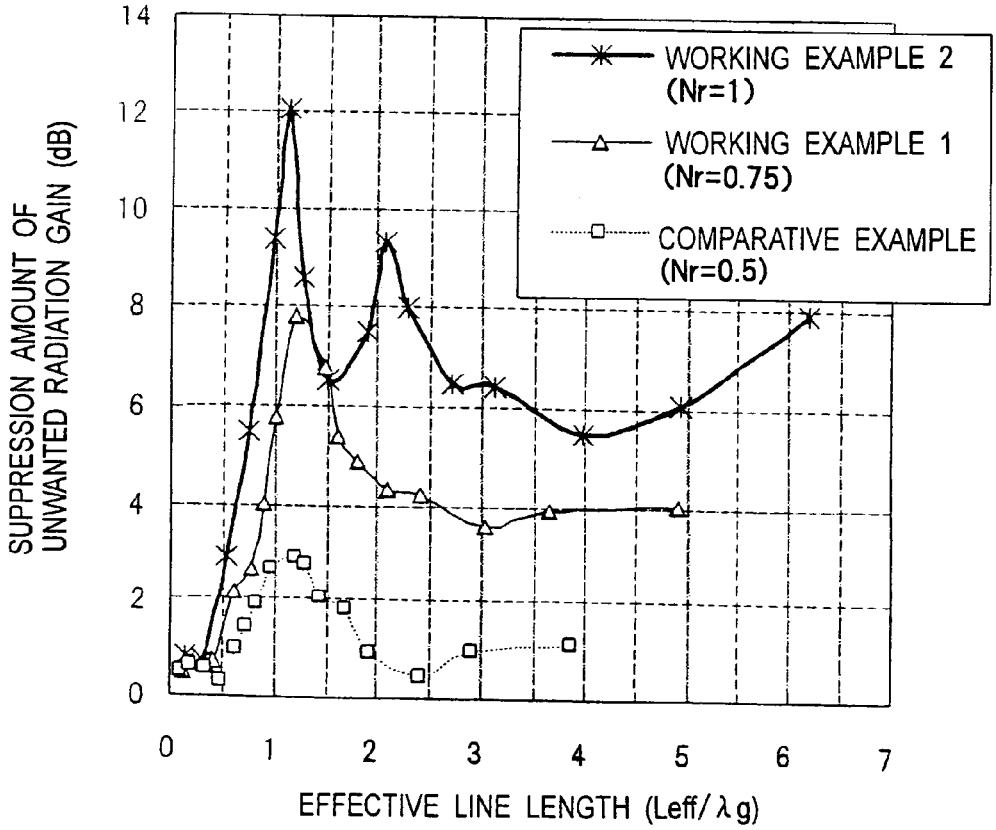
FIG. 17 is a view showing the effective line length dependence of unwanted radiation suppression amount in the transmission lines of Working Examples 1 and 2 of the present invention and Comparative Example.
Figure 18A:
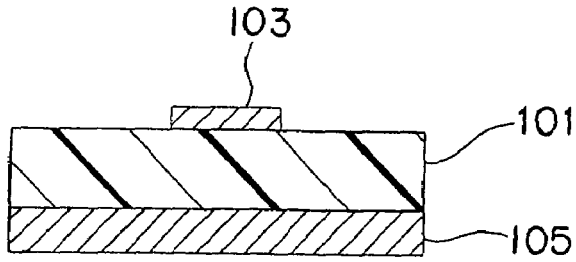
Fig. 18A PRIOR ART
FIG. 18A is a view showing a transmission line cross-sectional structure of a conventional transmission line in the case of single-end transmission.
Figure 18B:
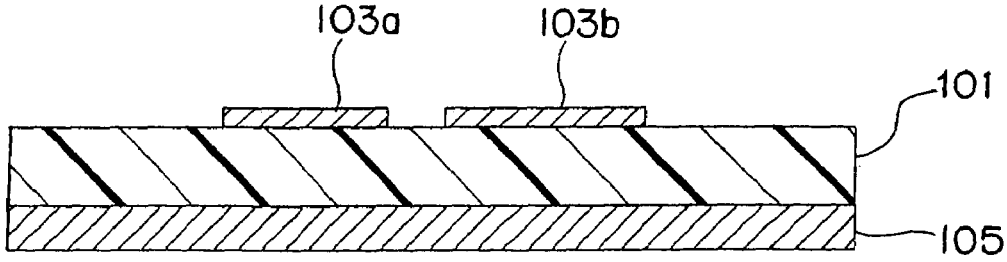
Fig. 18B PRIOR ART
FIG. 18B is a view showing a transmission line cross-sectional structure of a conventional transmission line in the case of differential signal transmission.

Further, FIG. 17 shows the effective line length Leff dependence of unwanted radiation characteristics in the transmission lines of Working Examples 1 and 2 and Comparative Example. In FIG. 17, the vertical axis represents the suppression amount of unwanted radiation gain in decibel against the comparison object of Prior Art Example, while the horizontal axis represents dimensionless number X obtained by normalizing the effective line length Leff by effective wavelength. The value in the horizontal axis can be derived from a phase progress amount of a transit signal in the transmission line, where the effective line length Leff, if X=0.5, corresponds to one half of the effective wavelength of the transmission frequency, and the effective line length Leff, if X=1, corresponds to 1 time the effective wavelength of the transmission frequency.

As shown in FIG. 17, in the case where the effective line length is less than one half of the effective wavelength of the transmission frequency, when the line length is relatively short against the electromagnetic wave, indeed the unwanted radiation intensity derived from the transmission line of the present invention is suppressed in comparison with the conventional transmission line, but the suppression amount is as low as 0.5 dB. Next, as the effective line length Leff goes beyond one half of the effective wavelength of the transmission frequency, the effect that depends on the line length begins to work so that the unwanted radiation intensity begins to lower, where the improvement amount reaches a maximum value when the effective line length Leff becomes 1 time the effective wavelength of the transmission frequency. The maximum value of improvement amount depends also on the number of rotations Nr, reaching 12 dB in Working Example 2 (Nr=1) and about 8 dB in Working Example 1 (Nr=0.75). Also in the case where the line length was elongated to a distance longer than 1 time the effective wavelength, indeed the improvement amount slightly decreased, unwanted radiation beyond the unwanted radiation amount of Prior Art Example was not observed. In particular, a suppression amount of 7.8 dB was obtained in Working Example 2 (Nr=1), and a suppression amount of 4 dB was obtained in Working Example 1 (Nr=0.75) constantly even at an upper-limit value of the measurement range. Further, as apparent from FIG. 17, in Comparative Example with the number of rotations Nr=0.5, the range over which improvement was obtained in the horizontal axis was limited to values around 1 and, although unwanted radiation beyond the unwanted radiation amount of Prior Art Example was not observed, yet the effect of unwanted radiation intensity suppression resulted in a low one in comparison with Working Examples 1 and 2.

Figure 20:
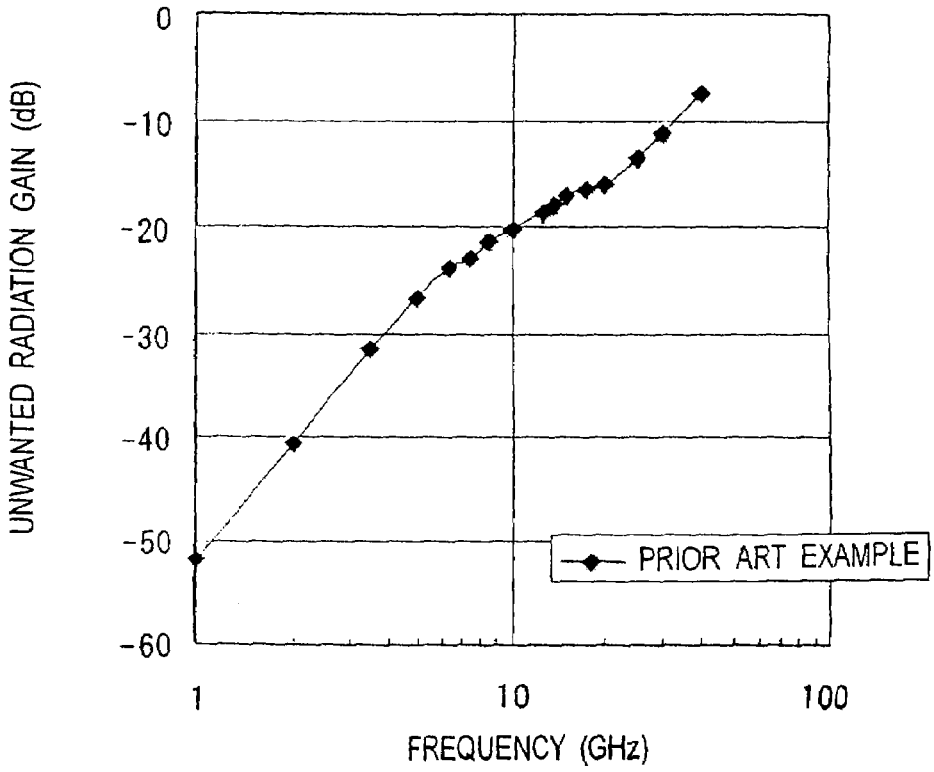
Fig.20 PRIOR ART
FIG. 20 is a view showing the frequency dependence of unwanted radiation intensity derived from the transmission line of a prior art example.

FIG. 20 shows results wherein a top face of a dielectric substrate 101 of resin material having a dielectric constant of 3.8, a thickness H of 250 μm and having a grounding conductor layer 105 provided over its entire rear face, was fabricated a radio-frequency circuit having a structure that one signal conductor, i.e. transmission line 291, with a wiring width W of 100 μm was placed in a linear shape with a line length set to 1.5 cm, where unwanted radiation intensity generated from the circuit board was measured at enough distance. It is noted that the signal conductor was provided by a copper wire having an electrical conductivity of $3\times10^8$ S/m and a thickness of 20 μm. As a result of the measurement, FIG. 20 shows a view in a graph form showing the frequency dependence of unwanted radiation intensity, where the vertical axis represents unwanted radiation gain (dB) and the horizontal axis represents frequency (GHz). As shown in FIG. 20, the maximum unwanted radiation gain at each frequency against input power was −51.5 dB at a frequency of 1 GHz, −40.1 dB at a frequency of 2 GHz, −26.4 dB at a frequency of 5 GHz, −20.1 dB at a frequency of 10 GHz, and −16.0 dB at a frequency of 20 GHz, showing a tendency of increasing maximum unwanted radiation gain with increasing frequency.

As apparent from such a measurement result in the radio-frequency circuit of the prior art example, the conventional single-end transmission line technique, while under a desire for suppression of unwanted radiation, has difficulty in principle in suppressing the unwanted radiation at radio-frequency band, hence a problem of difficulty in meeting the desire.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The single-end transmission line according to the present invention is capable of suppressing unwanted radiation intensity toward vicinal spaces, and eventually capable of fulfilling both circuit area reduction by dense wiring and high-speed operations of the circuit, which has conventionally been difficult to achieve because of signal leakage, at the same time. Further, the present invention can be widely applied also to communication fields such as filters, antennas, phase shifters, switches and oscillators, and moreover is usable also in power transmission or fields involving use of radio-technique such as ID tags.

The disclosure of Japanese Patent Application No. 2005-97370 filed on Mar. 30, 2005, including specification, drawing and claims are incorporated herein by reference in its entirety.

What is claimed is:

1. One transmission line comprising:

a substrate comprising a dielectric or semiconductor;

one signal conductor which is placed on one surface of the substrate; and a grounding conductor layer which is placed on the other surface of the substrate, wherein the one signal conductor has a plurality of rotational-direction reversal structures each arranged so as to electrically be connected to one another in series from one end-side to the other end-side of the substrate, each of the plurality of the rotational-direction reversal structures comprising:

a first signal conductor which is arranged so as to be curved toward a first rotational direction within the one surface of the substrate; and a second signal conductor which is arranged so as to be curved toward a second rotational direction opposite to the first rotational direction within the one surface of the substrate and is placed in the one surface of the substrate so as to be electrically connected in series to the first signal conductor, wherein each of the plurality of the rotational-direction reversal structures has a transmission-direction reversal portion which extends along a direction from the other end-side to the one end-side of the substrate and which includes at least part of the first signal conductor and part of the second signal conductor; and no signal conductor except for the one signal conductor is placed on the one surface of the substrate.

2. The transmission line as defined in claim 1, wherein the curve of each one of the first signal conductor and the second signal conductor is circular-arc shaped.

3. The transmission line as defined in claim 1, wherein each one of the first signal conductor and the second signal conductor are placed in rotational point symmetry with respect to a center of a corresponding connecting portion between each one of the first signal conductor and the second signal conductor.

4. The transmission line as defined in claim 1, wherein each one of the first signal conductor and the second signal conductor has the curved shape having a rotational angle of 180 degrees or more.

5. The transmission line as defined in claim 1, wherein the plurality of rotational-direction reversal structures are placed over an effective line length which is 0.5 time or more as long as an effective wavelength at a frequency of a transmission signal.

6. The transmission line as defined in claim 1, wherein the transmission-direction reversal portion has a signal transmission direction which is a direction having an angle of 180 degrees with respect to a signal transmission direction from the one end-side to the other end-side of the substrate.

7. The transmission line as defined in claim 1, wherein the plurality of rotational-direction reversal structures are placed over an effective line length which is 1 time or more as long as an effective wavelength at a frequency of a transmission signal.

* * * * *

UNITED STATES PATENT AND TRADEMARK OFFICE

CERTIFICATE OF CORRECTION

PATENT NO. : 7,369,020 B2
APPLICATION NO. : 11/589141
DATED : May 6, 2008
INVENTOR(S) : Hiroshi Kanno et al.

It is certified that error appears in the above-identified patent and that said Letters Patent is hereby corrected as shown below:

On the Title Page, Item (54)

In Item "(54)", change the printed title "TRANSMISSION LINE COMPRISING A PLURALITY OF SERIALLY CONNECTED ROTATIONAL DIRECTION-REVERSAL STRUCTURES" to --TRANSMISSION LINE--.

Signed and Sealed this

Seventeenth Day of February, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,369,020 B2
APPLICATION NO. : 11/589141
DATED : May 6, 2008
INVENTOR(S) : Hiroshi Kanno et al.

It is certified that error appears in the above-identified patent and that said Letters Patent is hereby corrected as shown below:

On the Title Page, Item (54) and Column 1, lines 1-4

Change the printed title "TRANSMISSION LINE

COMPRISING A PLURALITY OF SERIALLY CONNECTED ROTATIONAL

DIRECTION-REVERSAL STRUCTURES" to --TRANSMISSION LINE--.

This certificate supersedes the Certificate of Correction issued February 17, 2009.

Signed and Sealed this

Seventeenth Day of March, 2009

John Doll

JOHN DOLL
*Acting Director of the United States Patent and Trademark Office*